US009481510B2

(12) United States Patent
Dobrinski et al.

(10) Patent No.: US 9,481,510 B2
(45) **Date of Patent: *Nov. 1, 2016**

(54) CONTAINER HAVING MULTIPLE LAYERS OF TRACKS INCLUDING AT LEAST ONE NON-LINEAR TRACK

(71) Applicant: Bradford Company, Holland, MI (US)

(72) Inventors: Brian T. Dobrinski, Zeeland, MI (US); Matthew S. Sanger, West Olive, MI (US); Justin V. Fazio, Grand Rapids, MI (US)

(73) Assignee: Bradford Company, Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/166,797

(22) Filed: May 27, 2016

(65) Prior Publication Data

US 2016/0272416 A1 Sep. 22, 2016

Related U.S. Application Data

(63) Continuation of application No. 14/054,271, filed on Oct. 15, 2013, now Pat. No. 9,382,037.

(51) Int. Cl.

| | |
|---|---|
| ***B65D 81/02*** | (2006.01) |
| ***B65D 1/24*** | (2006.01) |
| ***B65D 88/54*** | (2006.01) |
| ***B65D 90/12*** | (2006.01) |
| *B65D 19/44* | (2006.01) |

(52) U.S. Cl.

CPC ..... *B65D 88/546* (2013.01); *B65D 90/12* (2013.01); *B65D 19/44* (2013.01); *B65D 2585/6887* (2013.01)

(58) Field of Classification Search

CPC .... B65D 19/44; B65D 88/546; B65D 90/12; B65D 2585/6887

USPC ..... 206/335, 386, 485, 583, 591, 592, 594, 206/600; 220/1.5, 529, 530, 534, 544

See application file for complete search history.

(56) References Cited

U.S. PATENT DOCUMENTS

| | | | |
|---|---|---|---|
| 634,589 | A | 10/1899 | Russell |
| 1,712,168 | A | 5/1929 | Rand, Jr. |
| 2,788,912 | A | 4/1957 | Simonsen |
| 3,554,429 | A | 1/1971 | Cohen |
| 4,105,220 | A | 8/1978 | Pacific |
| 4,527,694 | A | 7/1985 | Bolt et al. |
| 4,602,815 | A | 7/1986 | Boots et al. |

(Continued)

FOREIGN PATENT DOCUMENTS

| | | |
|---|---|---|
| DE | 19549166 | 3/1997 |
| DE | 20101374 | 4/2001 |

(Continued)

*Primary Examiner* — Luan K Bui

(74) *Attorney, Agent, or Firm* — Wood, Herron & Evans, LLP

(57) ABSTRACT

A container for holding product therein during shipment and being returned for reuse has a base and opposed sides, linear and non-linear tracks, and a plurality of dunnage supports extending between the tracks. At least one of the tracks on each side may be non-linear in the shape of a "C" or "U" or "J". One type of dunnage support comprises end members and a tubular middle member, the end members being movable along the tracks. The dunnage supports support dunnage, such as pouches.

22 Claims, 23 Drawing Sheets

(56) References Cited

U.S. PATENT DOCUMENTS

| | | | | |
|---|---|---|---|---|
| 4,685,571 | A | 8/1987 | Hoss | |
| 4,721,317 | A | 1/1988 | Avot | |
| 4,770,314 | A | 9/1988 | Giesler | |
| 4,821,879 | A | 4/1989 | Kupersmit | |
| 4,864,686 | A | 9/1989 | Lasier et al. | |
| 4,988,006 | A | 1/1991 | Lundin | |
| 5,238,139 | A | 8/1993 | Bisceglia | |
| 5,324,105 | A | 6/1994 | Christensen | |
| 5,407,262 | A | 4/1995 | Christian et al. | |
| 5,560,507 | A | 10/1996 | Arpin et al. | |
| 5,725,119 | A | 3/1998 | Bradford et al. | |
| 5,813,566 | A * | 9/1998 | Bradford | B65D 19/18 206/298 |
| 5,815,903 | A | 10/1998 | Foster et al. | |
| 6,062,410 | A | 5/2000 | Bradford et al. | |
| 6,164,440 | A | 12/2000 | Van Bree | |
| 6,202,884 | B1 * | 3/2001 | Verkerke | B65D 11/18 206/583 |
| 6,230,916 | B1 | 5/2001 | Bradford et al. | |
| 6,305,764 | B1 | 10/2001 | Kortman et al. | |
| 6,540,096 | B1 | 4/2003 | Bazany et al. | |
| 6,830,156 | B2 | 12/2004 | MacKelvie | |
| 7,125,062 | B2 | 10/2006 | Kiester et al. | |
| 7,322,485 | B2 | 1/2008 | Bradford et al. | |
| 7,748,559 | B2 | 7/2010 | Bradford | |
| 7,762,422 | B2 | 7/2010 | Dobrinski | |
| 7,870,970 | B2 | 1/2011 | Fisk | |
| 8,100,282 | B2 | 1/2012 | Nyeboer et al. | |
| 8,109,216 | B2 * | 2/2012 | Nono | A47B 57/10 108/107 |
| 8,607,978 | B2 | 12/2013 | Bradford et al. | |
| 9,016,507 | B2 | 4/2015 | Bradford et al. | |
| 9,211,999 | B2 | 12/2015 | Bublitz et al. | |
| 2003/0168461 | A1 | 9/2003 | Richardson | |
| 2006/0249416 | A1 | 11/2006 | Bradford et al. | |
| 2006/0249514 | A1 * | 11/2006 | Bazany | B65D 1/22 220/544 |
| 2006/0249515 | A1 * | 11/2006 | Dobrinski | B65D 1/22 220/544 |
| 2006/0278646 | A1 * | 12/2006 | Bradford | B65D 1/22 220/544 |
| 2008/0023470 | A1 | 1/2008 | Bradford | |
| 2008/0078729 | A1 | 4/2008 | Bazany et al. | |
| 2010/0072206 | A1 | 3/2010 | Doyle | |
| 2012/0043865 | A1 | 2/2012 | Newkirk et al. | |
| 2012/0061387 | A1 | 3/2012 | Nam | |
| 2013/0057135 | A1 * | 3/2013 | Bradford | B65D 85/68 312/321 |
| 2015/0101956 | A1 | 4/2015 | Dobrinski et al. | |
| 2016/0114970 | A1 * | 4/2016 | Bradford | B65D 19/06 220/544 |

FOREIGN PATENT DOCUMENTS

| | | |
|---|---|---|
| DE | 20318172 | 5/2004 |
| FR | 1455414 | 4/1966 |
| FR | 2860504 | 4/2005 |
| JP | 659230 | 8/1994 |
| WO | 9310024 | 5/1993 |

* cited by examiner

CONTAINER HAVING MULTIPLE LAYERS OF TRACKS INCLUDING AT LEAST ONE NON-LINEAR TRACK

CROSS-REFERENCE TO RELATED APPLICATIONS

This application is a continuation of U.S. patent application Ser. No. 14/054,271 filed Oct. 15, 2013, now U.S. Pat. No. 9,382,037, which is fully incorporated by reference here.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area, which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time-consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or workpieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, a line worker or employee must lean forward and bend down into the container to insert or remove a part or workpiece from a lower portion of the container. This movement by the line worker is ergonomically unfriendly because the line worker must lean forward and bend down and lift a part or workpiece up and over a wall into the container to remove the part or workpiece from inside the container. Similarly, when a part or workpiece must be inserted into a container, the line worker may have to lean forward and insert the part, which may be heavy, into its proper location inside the container, again experiencing ergonomically unfriendly movements. Such movements may be necessary with many top loading containers and/or containers having multiple layers or levels of parts.

Depending upon the number of times the line worker repeats this unnatural motion into the interior of the container, strain in the back, legs and arms may result. The size and/or weight of the parts or workpieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

SUMMARY OF THE INVENTION

The present invention provides a container for holding product therein during shipment. The container comprises a base and two opposed sides. The base and sides may be part of a metal frame or part of a plastic pallet box. In some embodiments, a plurality of straps may be supported by the container. In some instances, multiple straps may be secured to each of the opposed sides of the container. A plurality of tracks may be secured to the straps on each of the opposed sides of the container. At least one of the tracks on each side may be non-linear. For purposes of this document, a non-linear track includes, but is not limited to, a generally U-shaped track and/or a generally C-shaped track and/or a generally J-shaped track. In one embodiment, the container has two tracks on each side of the container, an upper non-linear, generally U-shaped track and a linear or straight track below the upper non-linear, generally U-shaped track.

Each of the generally U-shaped tracks comprises two generally parallel portions joined by a connecting portion. The parallel portions may be generally horizontally oriented and the connecting portion may be generally vertically oriented.

The container further comprises a plurality of movable dunnage supports supported by the tracks. Each dunnage support extends between opposed tracks of the same layer or level. For purposes of this document, the term "dunnage support" may be a unitary member or multiple components secured together in an assembly. For example, a "dunnage support" may comprise in combination a tubular middle member and a pair of end members which move inside or along stationary tracks or track assemblies. A unitary dunnage support may be a single member, such as those disclosed in U.S. patent application Ser. No. 13/225,835, published as US2013/0057135, which is fully incorporated by reference herein.

For purposes of this document, the term "track" may be a unitary member or multiple components secured together. The present invention is not intended to be limited to the tracks like those illustrated and described herein. For example, a "track" may comprise a rail attached to one or more walls of a container. The term "track" is intended to include any number of stationary objects along which support members or support member assemblies, as defined and/or illustrated herein, may slide or move during the loading or unloading of products from dunnage inside the container.

The container further comprises dunnage supported by the dunnage supports. The dunnage may be pouches or any other known dunnage. The dunnage may be secured to the dunnage supports in any known manner, such as sewing.

According to another aspect of the present invention, the container has a base and opposed sides. The base and sides may be part of a metal frame or part of a plastic pallet box. The container further comprises a plurality of tracks supported by each of the opposed sides of the container at different levels. At least one of the tracks on each side of the container may be non-linear. In one embodiment, each of the non-linear tracks is generally U-shaped. A plurality of movable dunnage supports extend between opposed tracks of each level and movable along corresponding tracks. In some embodiments, each of the dunnage supports comprises a pair of end members movable along the tracks and a middle member extending between the end members and secured to each end member. Pouches are supported by the dunnage supports.

The container may be adapted so that an operator located at the front of the container may pull product to be emptied from the rear of the container forwardly to a more ergonomically friendly position after products suspended from dunnage at the front of the container have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the dunnage supports and associated dunnage loaded with product rearwardly and load additional product in a more ergonomically friendly position or manner. For example, after product is loaded into dunnage suspended by adjacent dunnage supports, these dunnage supports and associated dunnage are pushed rearwardly to enable the loader to load additional product. Thus, the container allows product to be more efficiently and safely removed from the container or inserted therein without unnecessary stress or strain on the operator.

The end members of the dunnage supports may be made of plastic or any other desired material. Each side of the container may have linear and non-linear tracks along which the dunnage supports move to move dunnage supported by the dunnage supports closer to the user for loading or unloading product. Each end member may have at least one head located inside the interior of the track so the end member remains engaged with the track. The end member may have another head outside the track for preventing the dunnage material from entering the interior of the track.

The tracks may have openings therein and removable caps for covering and/or closing the openings. If one or more of the dunnage supports needs to be removed or inserted, a person may remove and/or insert one or more dunnage support via the openings in opposed tracks.

The ease of operation and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
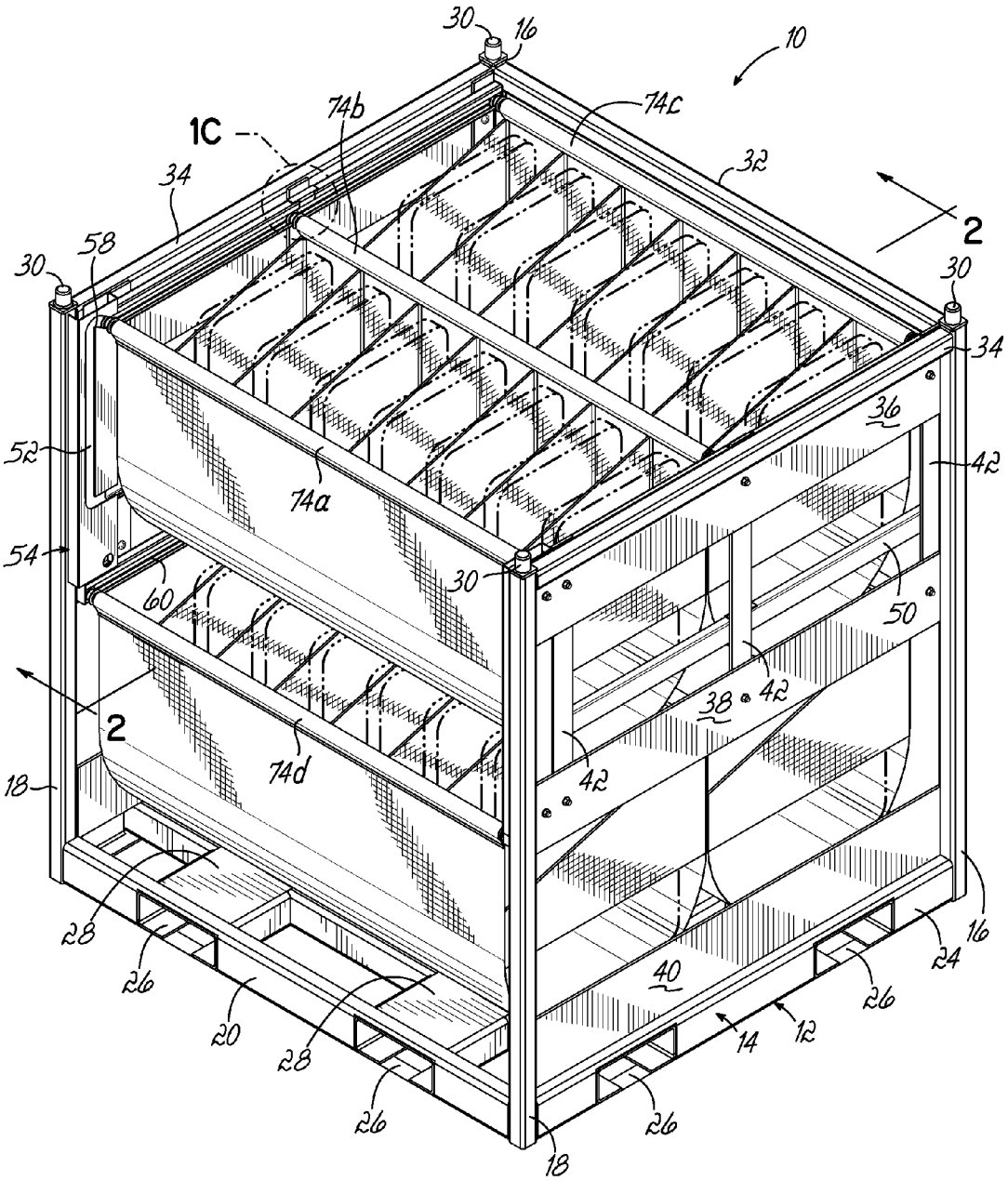
FIG. 1 is a perspective view of one embodiment of a reusable and returnable container.

Referring to FIG. 1, there is illustrated a reusable and returnable container 10 according to one embodiment. The reusable and returnable container 10, as shown, comprises an outer metal frame 12 having a base 14, two rear corner posts 16 and two front corner posts 18, all four corner posts 16, 18 extending upwardly from the base 14.

Figure 1A:
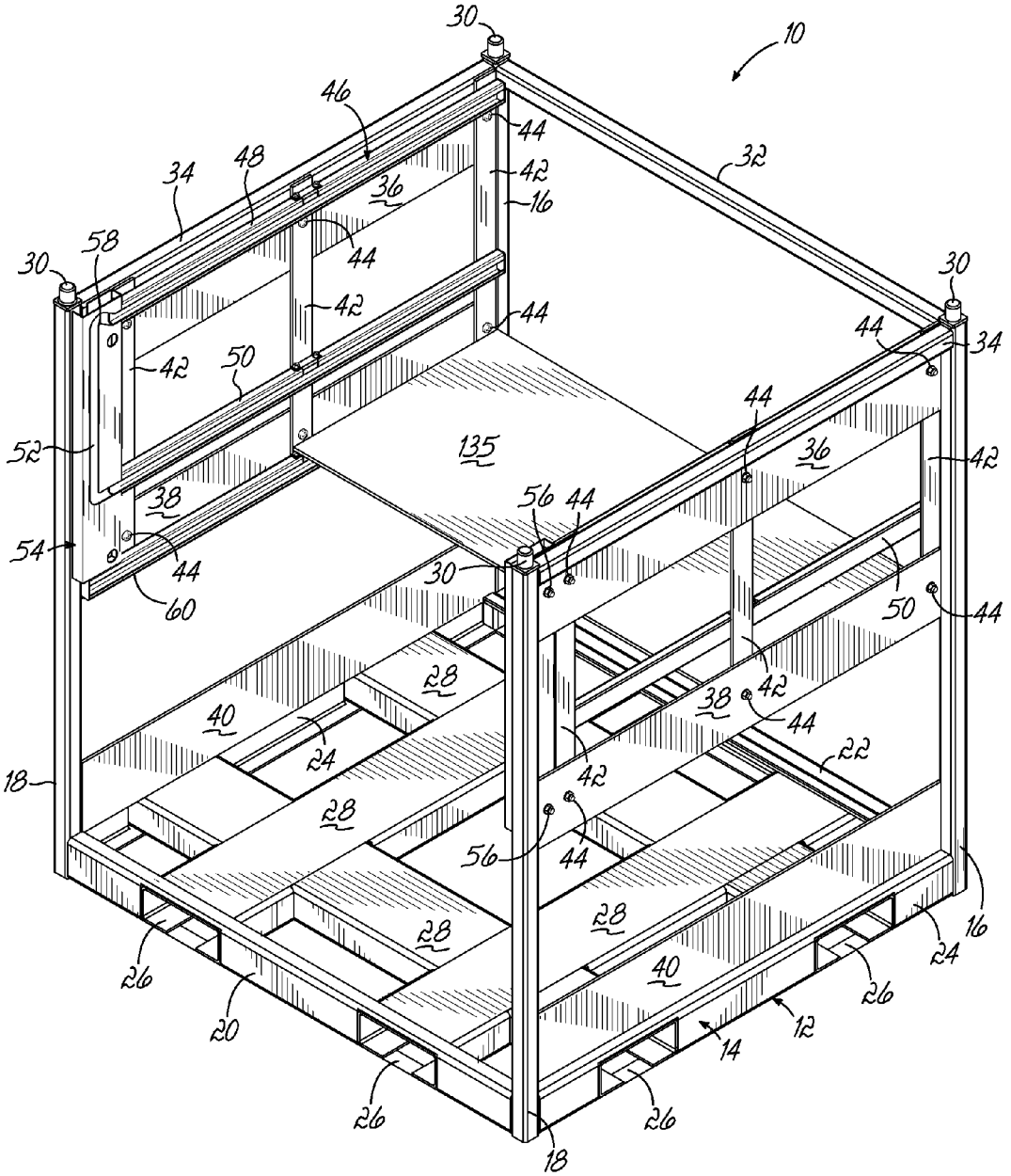
FIG. 1A is a perspective view of the container of FIG. 1 without the dunnage and dunnage supports.

As best shown in FIG. 1A, the base 14 is generally rectangular in shape and comprises a front perimeter member 20, a rear perimeter member 22 and two side perimeter members 24. The perimeter members of the base 14 may be secured together or secured to the corner posts 16, 18 via any conventional means, including welding. As best shown in FIG. 1A, two rectangular openings 26 extend through each of the base perimeter members 20, 22 and 24, each opening 26 communicating with the hollow interior of one of the intersecting interior members 28.

As best shown in FIG. 1A, the base 14 of the container 10 further comprises a plurality of intersecting interior members 28 extending between opposed perimeter base members 20, 22 and 24 and secured thereto, interior members 28 comprising part of the base 14 of the rack 12. Although four interior members 28 are shown in the base 14 of the container 10, any number of interior members may be used. Each of the interior members 28 of the base 14 is generally rectangular in cross-section and has a hollow interior ending in openings 26 of the perimeter base members 20, 22 and 24.

Figure 2:
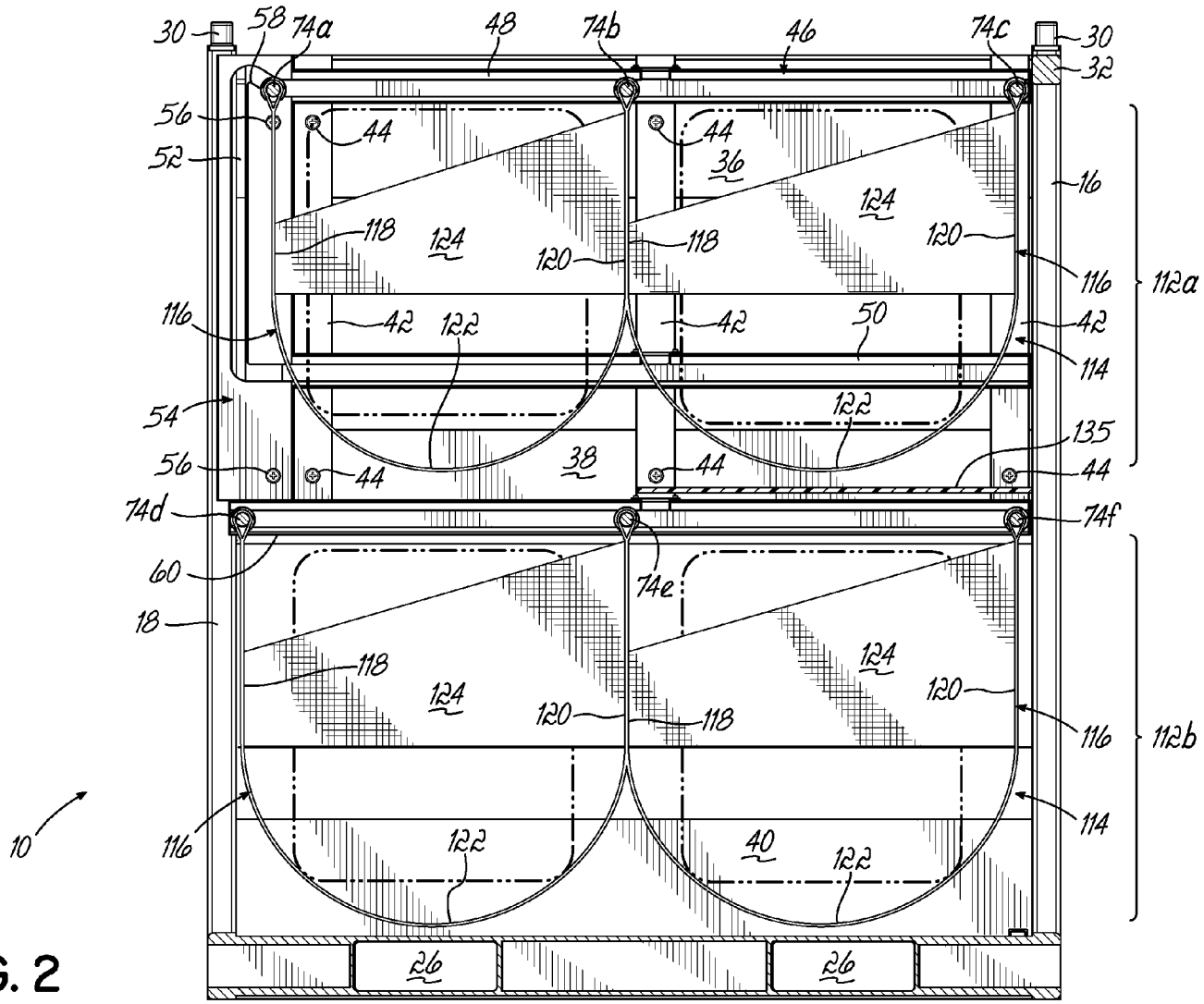
FIG. 2 is a cross-sectional view taken along the line 2-2 of FIG. 1.

As best shown in FIG. 2, each of the corner posts 16 and 18 is generally rectangular in cross-section, has a hollow interior, and a knob 30 at the top thereof for stacking purposes so that multiple containers 10 may be stacked upon one another. The knobs 30 of a first container fit inside the hollow interiors of the corner posts of another or second container located above the first container for stacking purposes.

The frame 12 further comprises an upper rear member 32 extending between the two rear corner posts 16 and is secured thereto. The frame 12 further comprises, on each side of the container, an upper side member 34 and three side panels 36, 38, 40, the side panels being vertically spaced from each other. Each of the side panels 36, 38 and 40 extends between one of the rear corner posts 16 and one of the front corner posts 18 and is secured thereto. On each side, upper side panel 36 is located above middle side panel 38, which is located above lower side panel 40. The two upper side members 34 are generally co-planar with the upper rear member 32.

Although one configuration of frame is illustrated, the present invention may be used with other types or configurations of frames.

As best shown in FIG. 1A, container 10 further comprises a plurality of generally vertically oriented spaced straps 42 secured to the upper and middle side panels 34, 36 with fasteners 44 on each side of container 10. Although the drawings show three straps 42 on each side of the container, any number of straps may be used on each side of the container. The straps 42 may be made of metal or any other desired material and may be secured to the container via any known method including welding.

Figure 1B:
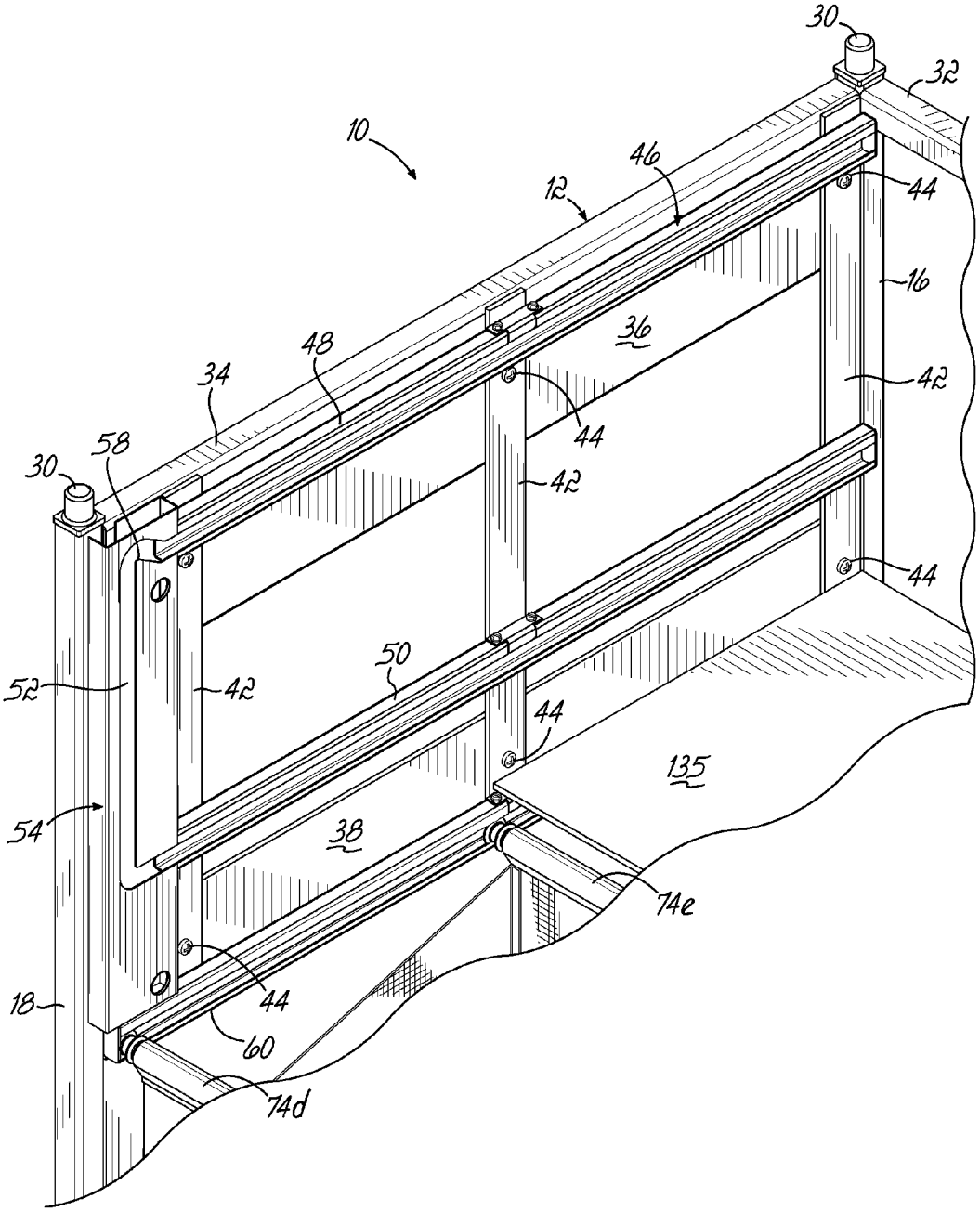
FIG. 1B is an enlarged perspective view of a portion of the container of FIG. 1 without some of the dunnage and dunnage supports.

As shown in FIG. 1A, a stationary generally U-shaped track 46 is secured to the straps 42 on each side of the container 10 in any desired manner, such as welding, for example. The generally U-shaped track 46 comprises stationary generally horizontally oriented upper and lower portions 48, 50, respectively, vertically spaced apart from each other at different levels. A connecting portion 52 joins the upper and lower linear portions 48, 50, respectively, of the generally U-shaped track 46 on each side of the container. The upper and lower portions 48, 50 of generally U-shaped track 46 are generally parallel to each other. The connecting portion 52 of the generally U-shaped track 46 comprises a cut-out or pathway through a one-piece generally vertically oriented member 54. The connecting member 54 is shown secured to the upper and middle side panels 34, 36 with fasteners 56 on each side of container 10. However, it may be secured in place in any known manner, such as welding, for example. As best shown in FIG. 1B, the connecting portion 52 of the generally U-shaped track 46 has an inhibitor or bump or curved upper portion 58 located at the intersection of the connecting portion 52 and upper portion 48 to aid in keeping the dunnage supports 74*a*-74*c* in the upper portion 48 of the generally U-shaped track 46, as shown in FIG. 2.

On each side of the container 10, a stationary linear lower track 60 is spaced below the lower linear portion 50 of the generally U-shaped track 46. As shown in FIG. 2, each linear lower track 60 has a greater length than the upper and lower linear portions 48, 50, respectively, of each of the generally U-shaped tracks 46. As shown in FIG. 1B, the linear lower track 60 is below the connecting member 54 when the container is in its position shown in FIG. 1. For purposes of this document, the description of the positioning of various components is described with respect to the container 10 being in the position illustrated in FIG. 1.

Figure 10:
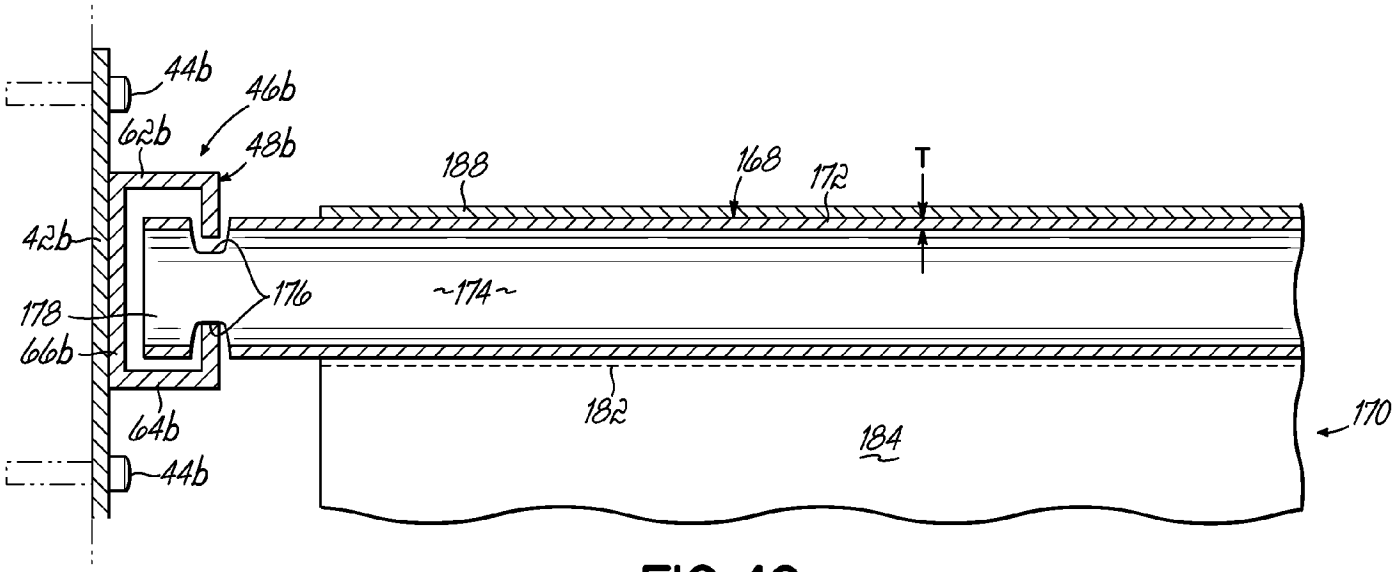
FIG. 10 is a cross-sectional view taken along the line 10-10 of FIG. 8.

Each generally U-shaped track 46 and each lower track 60 is fixed in a stationary position on one side of the container. The tracks are arranged in corresponding pairs at the same vertical levels. Each track may be one-piece or multiple pieces. Although the drawings disclose one generally U-shaped track 46 and one linear track 60 on each side of the container, the container may have any number of different levels or layers of tracks. As best shown in FIG. 10, each of the straight upper and lower portions 48, 50, respectively, of the generally U-shaped track 46, along with the lower linear track 60 may have an opening therein covered with a cover.

Figure 1C:
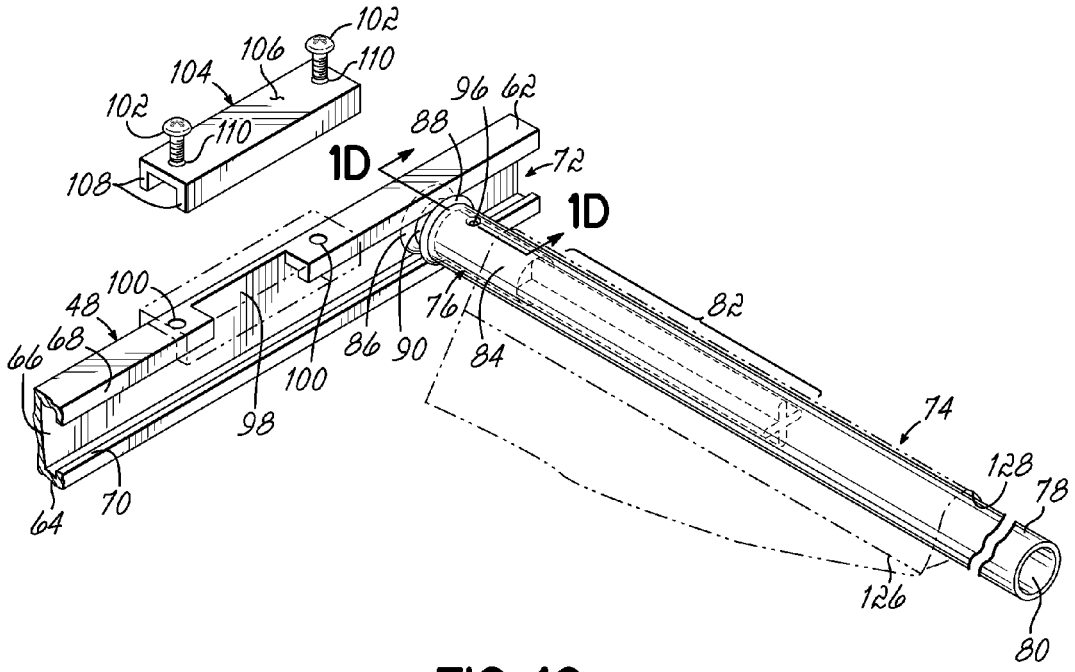
FIG. 1C is an enlarged view of the encircled area 10 of FIG. 1.

As best shown in FIG. 1C, each of the straight upper and lower portions 48, 50, respectively, of each generally U-shaped track 46, along with each lower linear track 60 has an upper wall 62, a lower wall 64 joined to the upper wall 62 by a side wall 66, and a lip 68 extending downwardly from the upper wall 62 and another lip 70 extending upwardly from the lower wall 64 defining an interior 72 of the upper portion of generally U-shaped track 46.

Referring to FIG. 1, container 10 further comprises a plurality of dunnage supports 74*a*-74*c*, each dunnage support 74*a*-74*c* extending between the upper linear portions 48 of the generally U-shaped track 46 at the same level on opposed sides of the container. As shown in FIG. 2, container 10 further comprises a plurality of dunnage supports 74*d*-74*f*, each dunnage support 74*d*-74*f* extending between the tracks 60 at the same level on opposed sides of the container.

As shown in FIG. 10, dunnage support 74*b*, along with each of the other dunnage supports, includes a pair of end members 76 and a tubular middle member 78 having a hollow interior 80 extending therebetween. The end members 76 are preferably made of injection molded plastic, such as nylon, but may be made of any other material. The tubular middle member 78 is preferably made of metal, but may be made of other suitable material, such as plastic.

As shown in FIG. 10, each end member 76 preferably has a first portion 82 having an X-shaped cross-sectional configuration and a second portion 84 having a circular cross-sectional configuration. Although one configuration of end member 76 is illustrated, any type or configuration of end member may be used with the present invention. In this embodiment, each end member 76 has a pair of heads 86, 88 at the end of the end member 76. Head 86 is furthest from the first portion 82 of the end member 76, and head 88 is spaced inwardly from head 86. The heads 86, 88 are spaced from one another to define a groove 90 therebetween which receives and retains the lips 68, 70 of either the generally U-shaped track 46 or the lower linear track 60. As shown in FIG. 10, head 86 is located inside the interior 72 of either the generally U-shaped track 46 or the lower linear track 60, and head 88 is located outside the interior 72 of either the generally U-shaped track 46 or the lower linear track 60. Head 86 keeps the end member 74 engaged with the track, while head 88 keeps the dunnage material out of the interior 72 of the track, thereby ensuring that the end members 76 may move smoothly along either the generally U-shaped track 46 or the lower linear track 60. Although one configuration of dunnage support is illustrated, the present invention may be used with any type or configuration of dunnage support for supporting dunnage so the dunnage may slide or move inside the container.

Figure 1D:
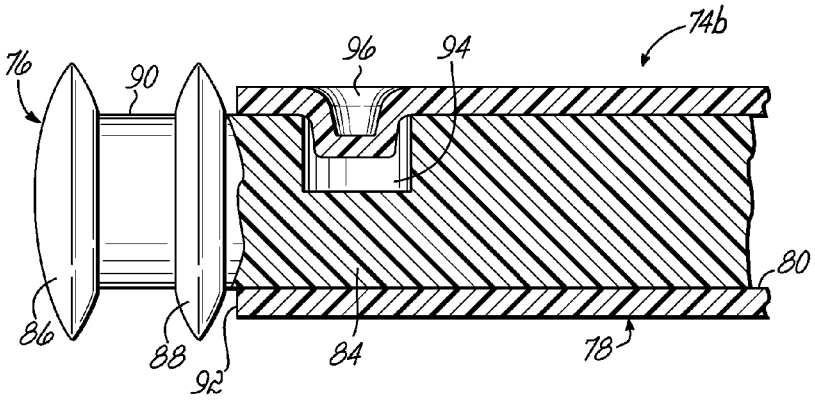
FIG. 1D is a cross-sectional view taken along the line 1D-1D of FIG. 10.

As shown in FIG. 1D, each end of tubular middle member 78 fits over at least one portion 84 of an end member 76. An end surface 92 of tubular middle member 78 abuts head 88 of end member 76. Each end member 76 of each dunnage support 74*a*-74*f* is adapted to engage and move along one of the tracks. The end members 76 preferably slide along the length or width of the tracks; however, different end members may rotate rather than slide along the tracks. Although one configuration of track and end member is shown and described, other types of end members and tracks may be used if desired.

As best shown in FIG. 1D, dunnage support 74*b*, along with each of the other dunnage supports, includes a pair of end members 76 (only one being shown in FIG. 1D). Each end member 76 has a groove 94 formed in a portion 84 therein. Dunnage support 74*b*, along with each of the other dunnage supports, further includes a tubular middle member 78 having a hollow interior 80 extending therebetween. As shown in FIG. 1C, each end of tubular middle member 78 fits over at least one portion 82 of an end member 76. An end surface 92 of tubular middle member 78 abuts head 88 of end member 76. The tubular support or middle member 78 is preferably made of metal, but may be made of other suitable material, such as plastic. As shown in FIG. 1D, tubular middle member 78 has two detents 96 therethrough (one at each end) in which the material of the tubular middle member 78 is pressed downwardly into the groove 94. This attachment between each of the two end members 76 and the tubular middle member 78 enables some movement therebetween. Such interaction between the end members 76 and tubular middle member 78 allows for a tolerance of approximately one-quarter inch on each side. The detents 96 prevent separation of the tubular middle member 78 from the end members 76 while allowing some movement therebetween as the detents 96 move within the grooves 94 formed in the end members 76.

FIG. 1C illustrates a dunnage support 74*b* used to support one side of one of the pouches. However, FIG. 1C illustrates another innovative feature or aspect of the invention. Upper portion 48 of generally U-shaped track 46 has an opening or cut-out 98 formed therein. Holes 100 are formed in the upper wall 62 of the upper portion 48 of generally U-shaped track 46, which are sized and threaded to receive fasteners 102. Although fasteners 102 are illustrated to be screws, they may be any other desirable fastener. A cap 104 is removably secured to the upper portion 48 of generally U-shaped track 46 to cover the opening or cut-out 98 formed in upper portion 48 of generally U-shaped track 46. As best seen in FIG. 1C, cap 104 has a generally inverted U-shaped cross-sectional configuration, including a top portion 106 and side portions 108 extending downwardly from the top portion 106. Holes 110 are formed through the top portion 106 of the cap 104 and sized to receive fasteners 102, as shown in FIG. 10. The fasteners 102 are adapted to pass through the holes 110 in the cap 104 and into the holes 100 in the upper wall 62 of the upper portion 48 of generally U-shaped track 46. Caps of alternative shapes or sizes may be used if desired.

When one of the end members 76, or any part of any of the dunnage supports is damaged or needs to be replaced for any reason, one may remove cap 104 after loosening fasteners 102, thereby exposing the opening or cut-out 98 of the upper portion 48 of generally U-shaped track 46. The damaged dunnage support may then be removed or inserted as necessary to repair or replace the damaged part or parts. The lower linear track 60, or any track described or illustrated herein, may have the same cut-out and cap for the same purpose.

As best shown in FIG. 2, container 10 comprises two layers or levels 112*a*-112*b* of vertically spaced dunnage 114, each level being in the form of a plurality of pouches 116, and are suspended by and supported by a plurality of dunnage supports. Each pouch 116 has a front wall 118, a rear wall 120, a bottom 122 and two side walls 124 extending therebetween. In some applications, the side walls 124 may be omitted. As shown in FIG. 2, the top of the front wall 118 is attached to one of the dunnage supports, and the rear wall 120 is attached to an adjacent dunnage support. Although the dunnage 114, as shown, comprises pouches, the dunnage may assume other shapes or configurations. A pouch 116 is supported by two adjacent dunnage supports. As shown in FIG. 1C, the fabric of the pouch 116 is sewn or otherwise secured together along a seam 126 to make a pocket 128 in which is located a tubular middle member 78 of the dunnage support.

Dunnage supports supporting pouches 116 are adapted to move from back to front inside the interior of the container 10, the end members 76 of the dunnage supports moving along the stationary tracks 46, 60.

Multiple pouches 116 are shown being formed or created from one piece of material draped or laying over and secured to the dunnage supports. Alternatively, each pouch 116 may be made from its own piece of material, in which case, the pouches 116 would not be interconnected other than via the straps or space limiters (not shown).

Figure 3A:
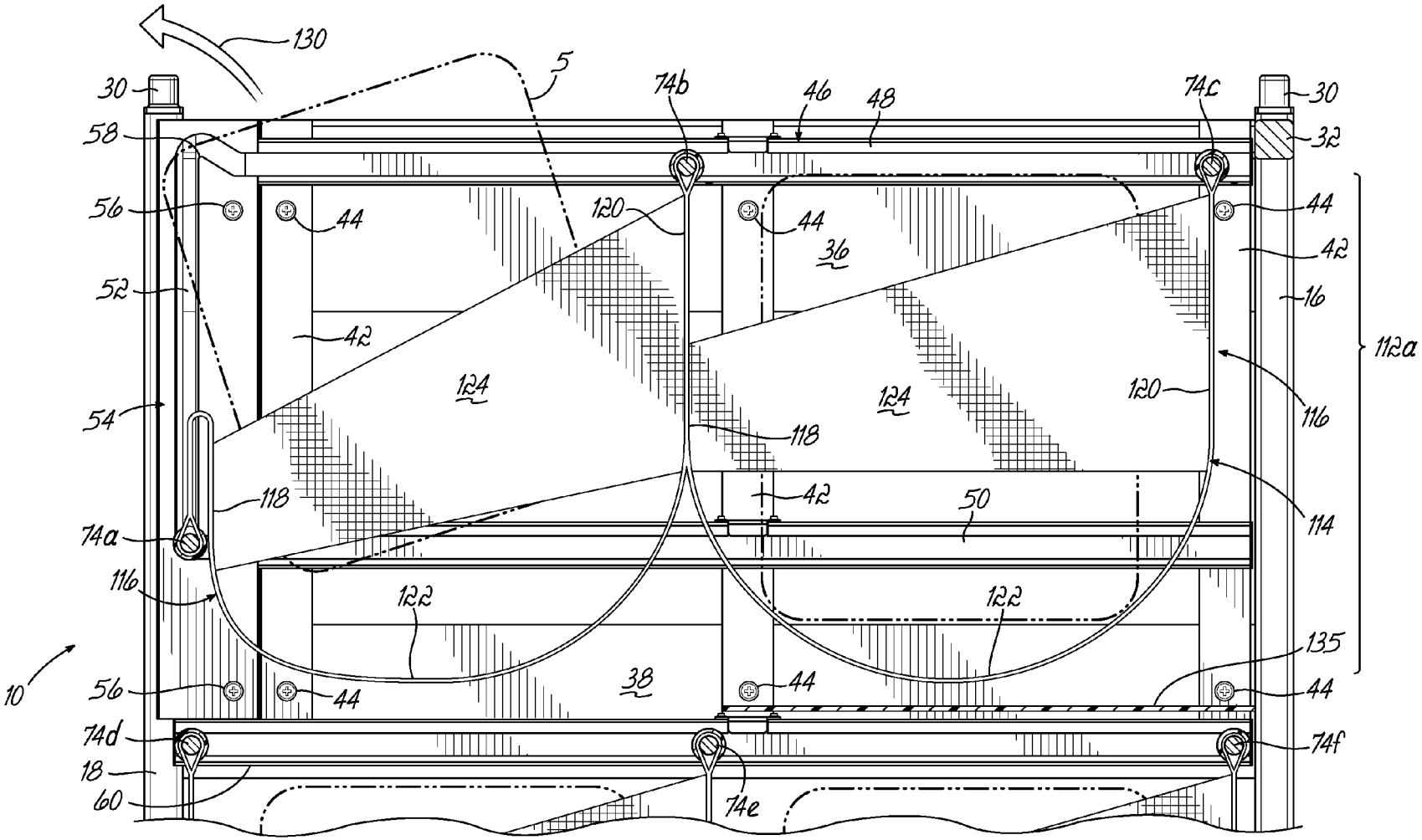
FIG. 3A is a cross-sectional view of a portion of the container of FIG. 1, showing the front product of an upper layer of products being removed.

FIGS. 3A-3E illustrate a method of unloading product 5 from the pouches 116 of the container 10. This unloading method comprises the first step of moving the front dunnage support 74*a* of the three dunnage supports 74*a*-74*c* extending between the upper portions 48 of generally U-shaped tracks 46 from its position shown in FIG. 2 over the stops or curved portions or bumps 58 of the generally U-shaped tracks 46 and into the connecting portions 52 of the generally U-shaped tracks 46 to a position shown in FIG. 3A. As shown in FIG. 3A, the next step comprises removing the front product 5 (closest to the front of the container) out of it dunnage pouch 116 in the upper or top level of dunnage 112*a* in the direction of arrow 130.

Figure 3B:
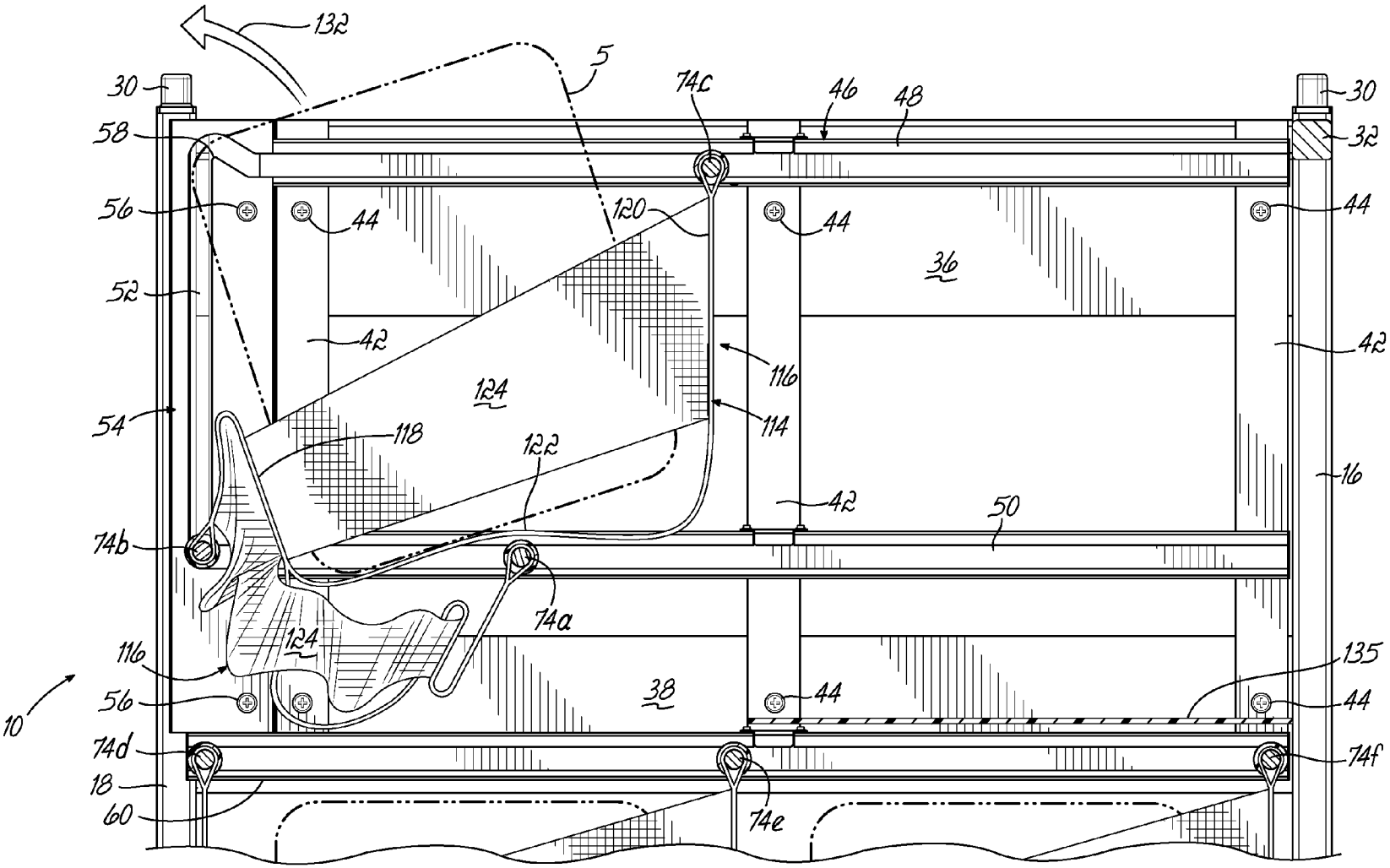
FIG. 3B is a cross-sectional view of a portion of the container of FIG. 1, showing the rear product of the upper layer of products being removed.

As shown in FIG. 3A, when dunnage support 74*a* is located extending between the bottoms of the connecting portions 52 of the generally U-shaped tracks 46, and dunnage support 74*b* is located extending between the upper portions 52 of the generally U-shaped tracks 46, an operator may easily remove a product inside the front pouch 116 because the dunnage support 74*a* is below dunnage support 74*b*. As shown in FIG. 3B, this is also true as regards dunnage supports 74*b* and 74*c* when an operator is unloading a second product 5 of the upper layer of dunnage. This orientation of the dunnage supports due to the configuration of the U-shaped tracks 46 helps an operator from an ergonomic standpoint, reducing the stress and strain on the body of the operator when unloading product from the upper layer or level of dunnage. Thus, the unique configuration of the upper generally U-shaped tracks 46 inside the container 10 may reduce the container owner's costs because workers or operators may have fewer injuries/days off due to injury.

As shown in FIG. 3B, the next step comprises moving dunnage support 74*b* (second from the front) from its position extending between the upper portions 48 of the generally U-shaped tracks 46 (shown in FIG. 3A) over the stops or curved portions or bumps 58 of the generally U-shaped tracks 46 and into the connecting portions 52 of the generally U-shaped tracks 46. In addition, dunnage support 74*a* is moved from its position shown in FIG. 3A extending between the connecting portions 52 of generally U-shaped tracks 46 to a position shown in FIG. 3B extending between the lower portions 50 of the generally U-shaped tracks 46. During this step, dunnage support 74*a* moves toward the rear of the container, the end members 76 of dunnage support 74*a* moving along the lower portions 50 of the generally U-shaped tracks 46.

Figure 3C:
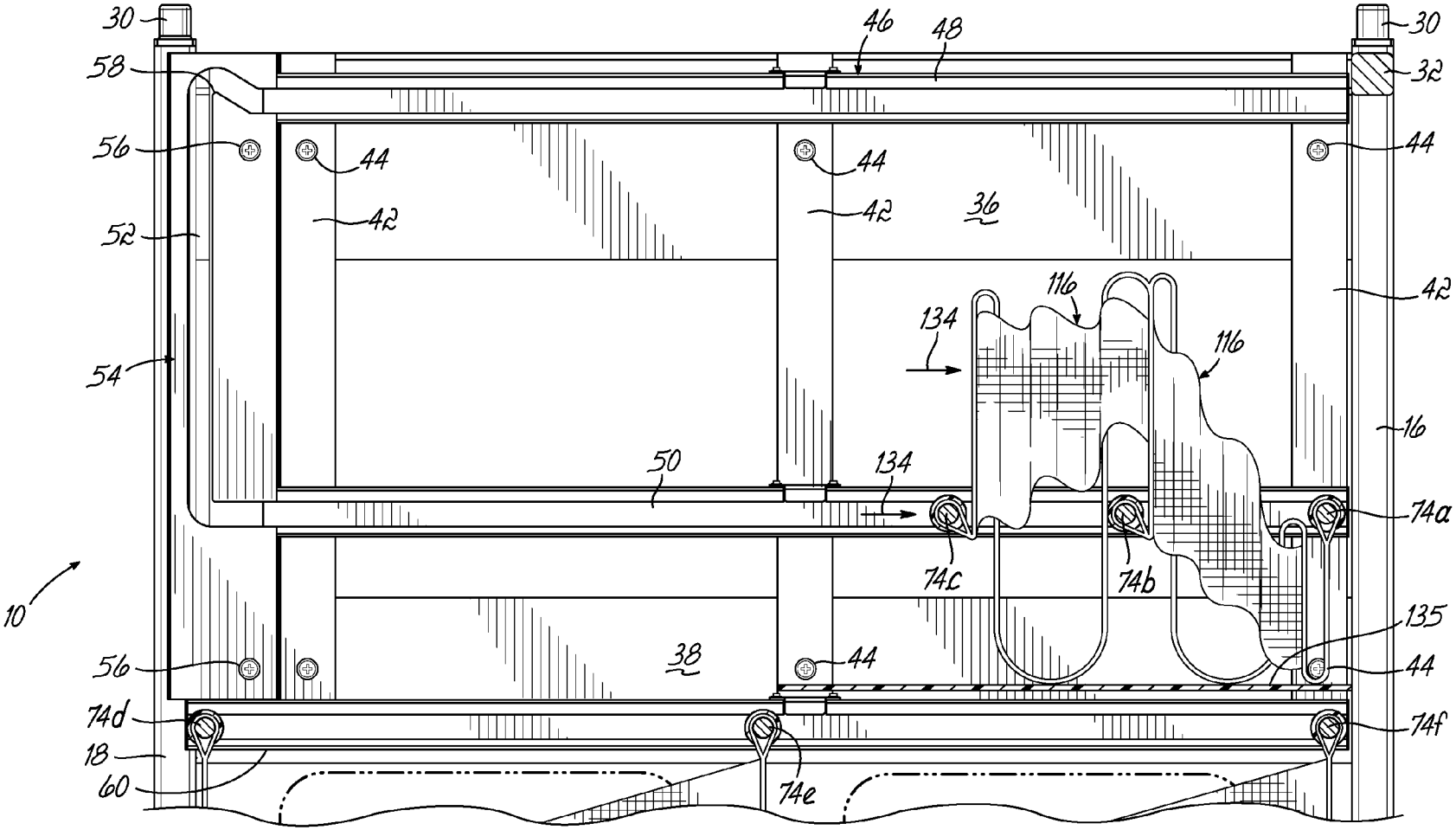
FIG. 3C is a cross-sectional view of a portion of the container of FIG. 1, showing the upper layer of dunnage being pushed rearwardly.

As shown in FIG. 3B, the next step comprises removing another product 5 from the other pouch 116 of the upper or top level of dunnage 112*a* in the direction of arrow 132. In the event the upper level of dunnage 112*a* has more than two pouches and three associated dunnage supports, each time a product 5 is removed from a pouch 116 of the upper level of dunnage 112*a*, the dunnage supports and associated dunnage are moved along the generally U-shaped tracks 46 in a generally counter-clockwise direction, as shown in FIG. 3A-3C. During this unloading process, the end members 76 at the ends of the dunnage supports move along the generally U-shaped tracks 46, as shown in FIGS. 3A-3C.

As shown in FIG. 3C, once all of the product 5 in the pouches 116 of the top level of dunnage 112*a* have been removed, the operator moves the dunnage supports 74*a*-74*c* along with associated empty pouches 116 of the top level of dunnage 112*a* rearwardly along the lower portions 50 of generally U-shaped tracks 46 in the direction shown by arrows 134 to a resting position on top of a stationary shelf 135. FIG. 1A shows the stationary shelf 135 secured to the straps 42 and extending therebetween. After all the product 5 have been removed from the top level of dunnage 112*a* and the dunnage 112*a* is stored on top of stationary shelf 135, as shown in FIG. 3C, dunnage support 74*a*, which was originally the front dunnage support of upper dunnage supports 74*a*-74*c*, is now the rear dunnage support extending between the lower portions 50 of the generally U-shaped tracks 46.

Figure 3D:
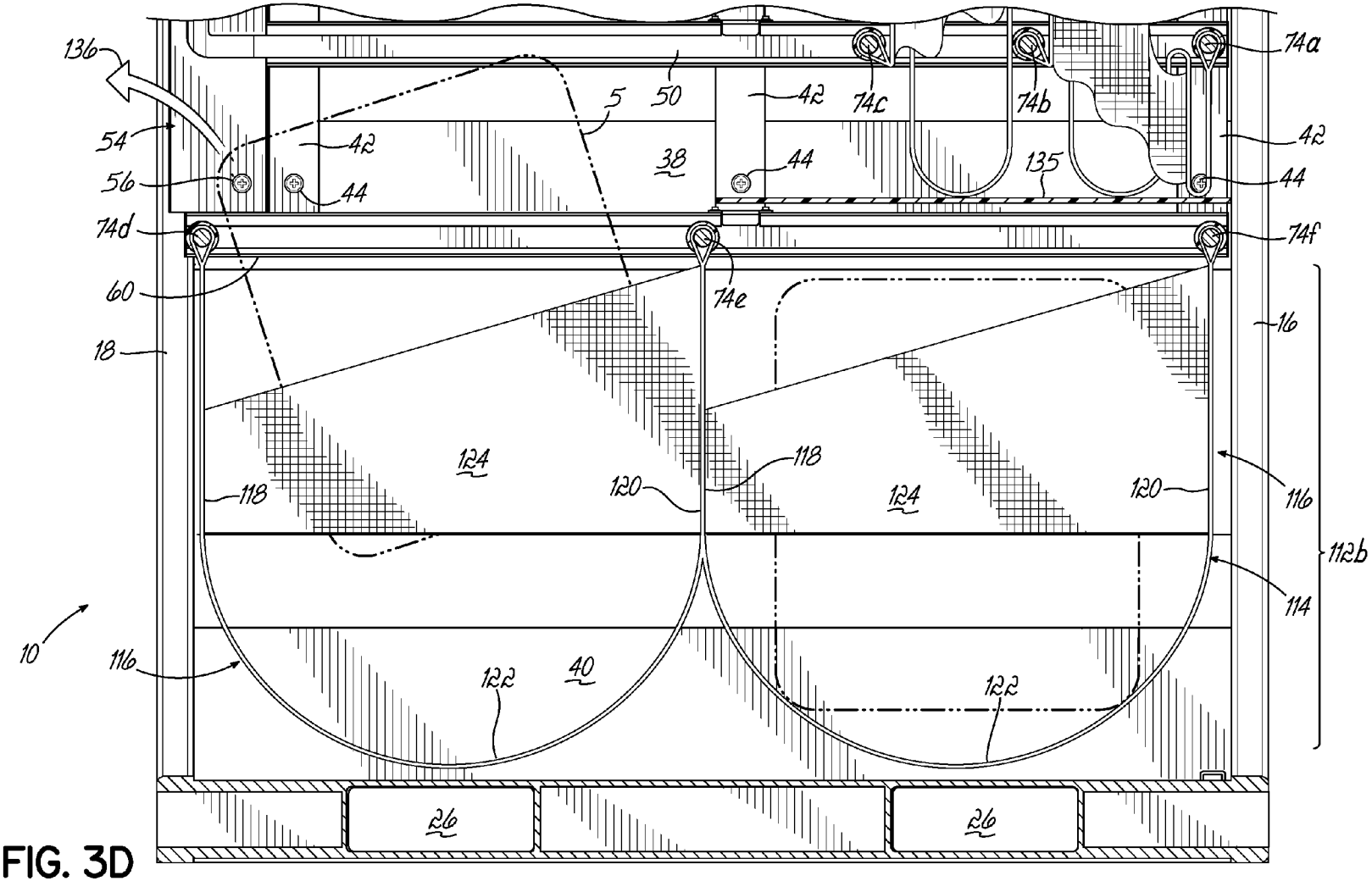
FIG. 3D is a cross-sectional view of a portion of the container of FIG. 1, showing the front product of the lower layer of products being removed.
Figure 3E:
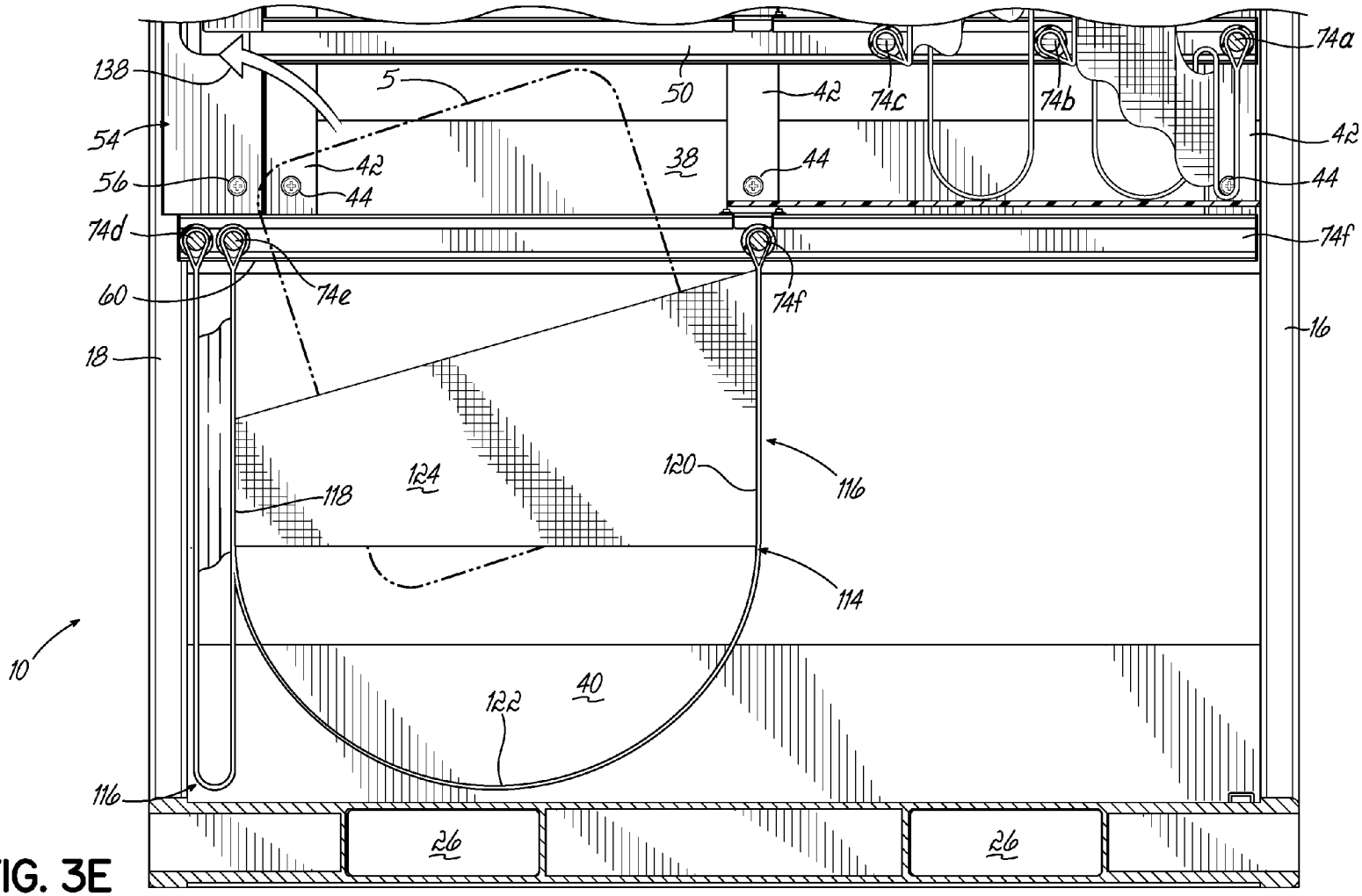
FIG. 3E is a cross-sectional view of a portion of the container of FIG. 1, showing the rear product of the lower layer of products being removed.

As shown in FIG. 3D, the process of unloading product 5 from container 10 is continued by an operator one level at a time moving downwardly. FIG. 3D shows a product 5 being removed from a front pouch 116 of the second lowest level of dunnage 112*b* in the direction of arrow 136. As shown in FIG. 3E, the next step comprises removing another product 5 from the rear pouch 116 of the bottom or lower level of dunnage 112*b* in the direction of arrow 138. When all of the product 5 of lower level 112*b* are removed, the container may be shipped to its desired destination. In the event the container has more than two levels, this process of removing product is repeated one layer or level at a time, each time all the products 5 are removed from the pouches 116 of a level, and each of the dunnage supports are pushed rearwardly to a rear portion of the container, creating open space for the operator to remove products from the next lowest level.

Figure 3F:
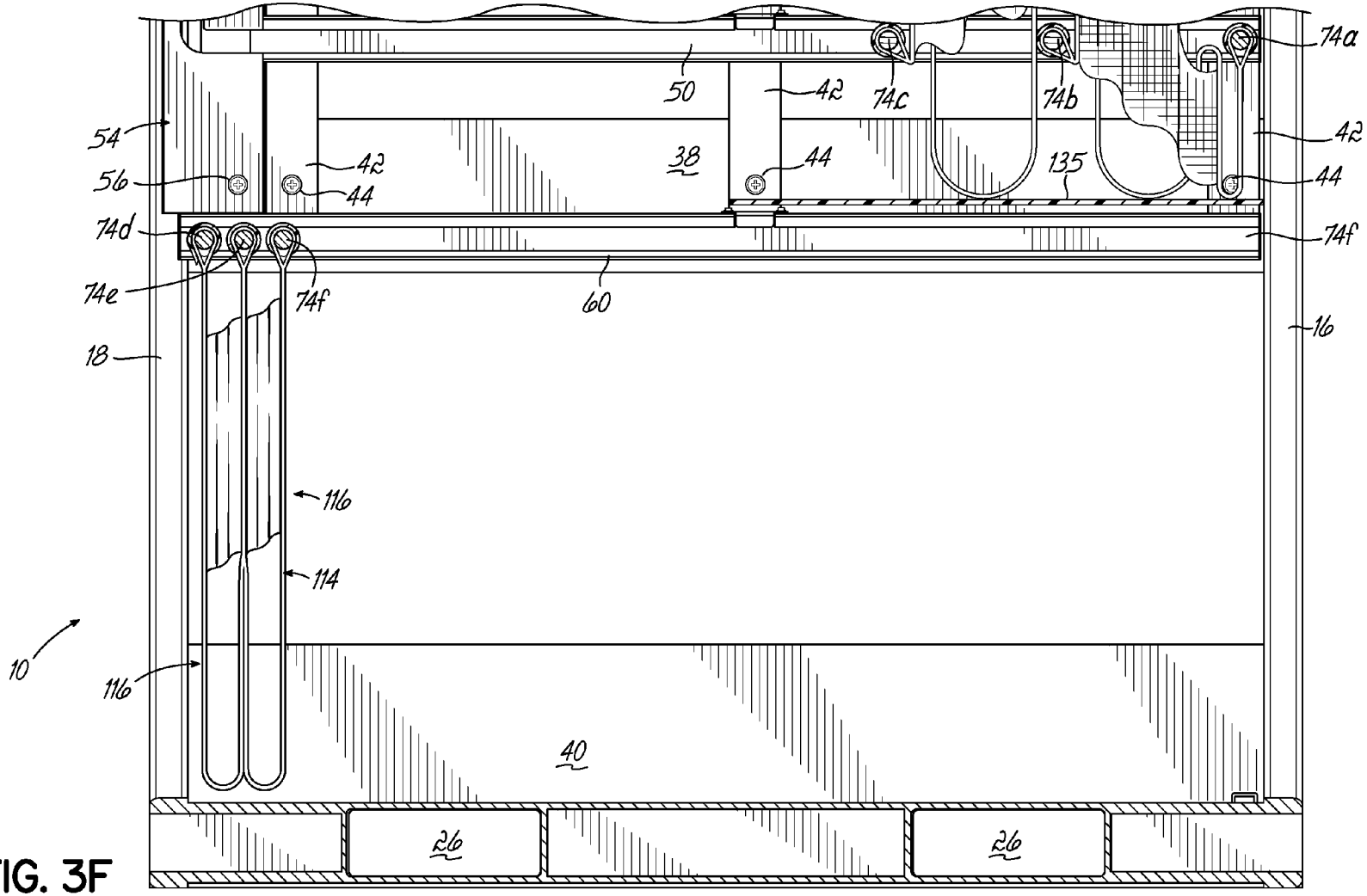
FIG. 3F is a cross-sectional view of a portion of the container of FIG. 1, showing both layers of dunnage emptied.

FIG. 3F illustrates the empty container 10 still having the dunnage therein, which may then be shipped back to its original location or any desired location for loading the empty dunnage with product. During the unloading and loading processes, the upper and lower tracks 46, 60, respectively, remain stationary fixedly secured to the container 10. The dunnage supports 74*a*-74*f* and dunnage 114 hanging from the dunnage supports move inside the container with the assistance of an operator during the loading and unloading processes.

Figure 4A:
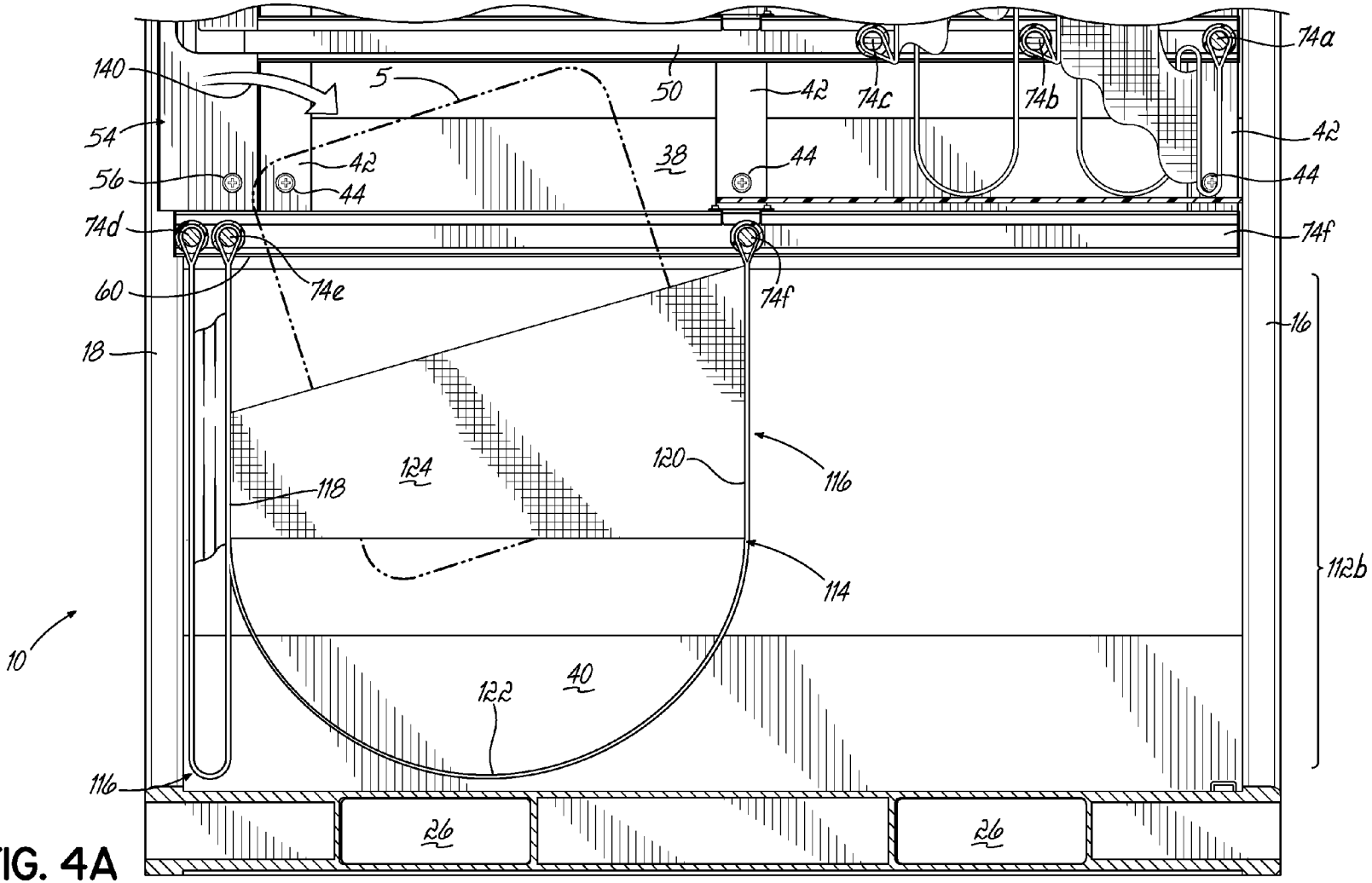
FIG. 4A is a cross-sectional view of a portion of the container of FIG. 1, showing a product being inserted into a rear pouch of the lower layer of dunnage.

FIGS. 4A-4F illustrate a method of loading product 5 into the pouches 116 of emptied container 10. As shown in FIG. 4A, the first step of the loading process comprises loading a product 5 into rear pouch 116 (furthest away from the front of the container) of the bottom level of dunnage 112*b* in the direction of arrow 140.

Figure 4B:
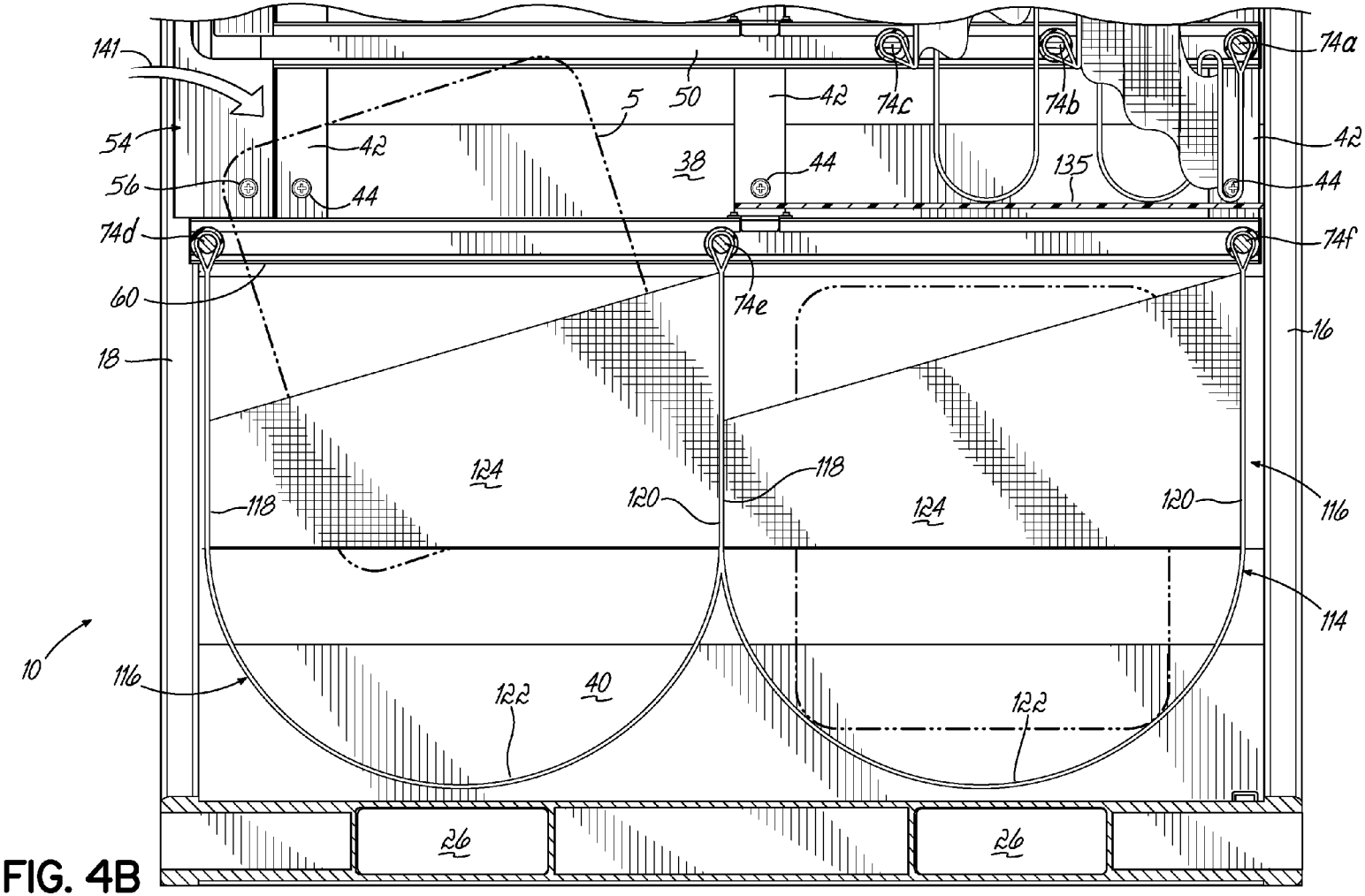
FIG. 4B is a cross-sectional view of a portion of the container of FIG. 1, showing a product being inserted into a front pouch of the lower layer of dunnage.

As shown in FIG. 4B, the next step comprises moving dunnage supports 74*e* and 74*f* supporting the loaded pouch 116 of the bottom level 112*b* towards the rear of the container, the end members 76 of dunnage supports 74*e* and 74*f* moving along the tracks 60, the loaded rear pouch 116 containing a product 5. FIG. 4B illustrates an operator (not shown) loading a product 5 into front pouch 116 (closest to the front of the container) of the bottom level of dunnage 112*b* in the direction of arrow 141. In the event the bottom level 112*b* of dunnage has more than two pouches, the process of loading one pouch at a time of the bottom level 112*b* continues until each pouch of the bottom level 112*b* is full.

Figure 4C:
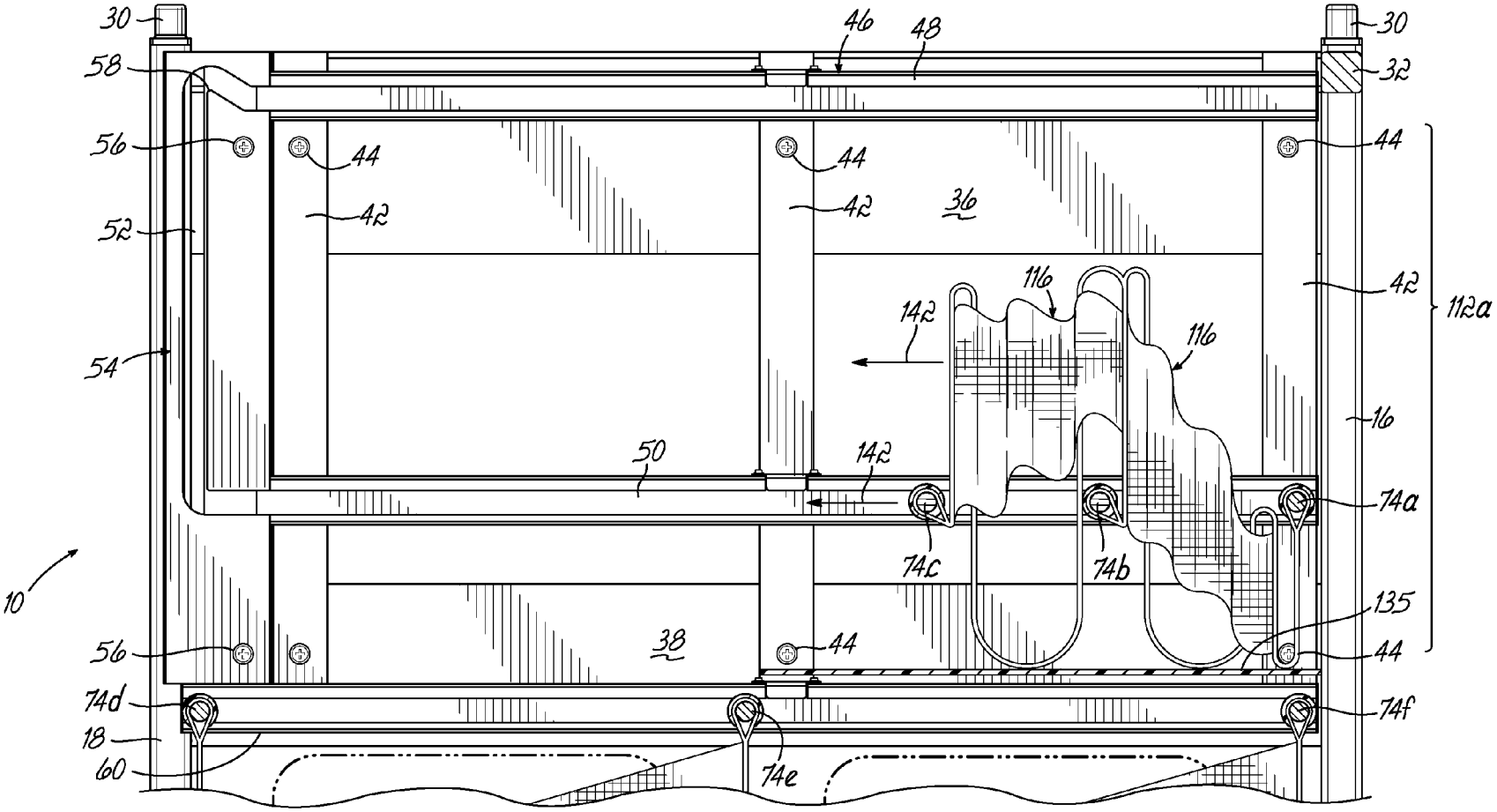
FIG. 4C is a cross-sectional view of a portion of the container of FIG. 1, showing the upper layer of dunnage being moved forwardly.

As shown in FIG. 4C, after the bottom level 112*b* of dunnage is full, the empty pouches 116 of the upper level 112*a* of dunnage are moved or pulled toward the front of the container in the direction of arrows 142, the dunnage supports 74*a*-74*c* move forwardly along the lower portions 50 of the generally U-shaped tracks 46.

Figure 4D:
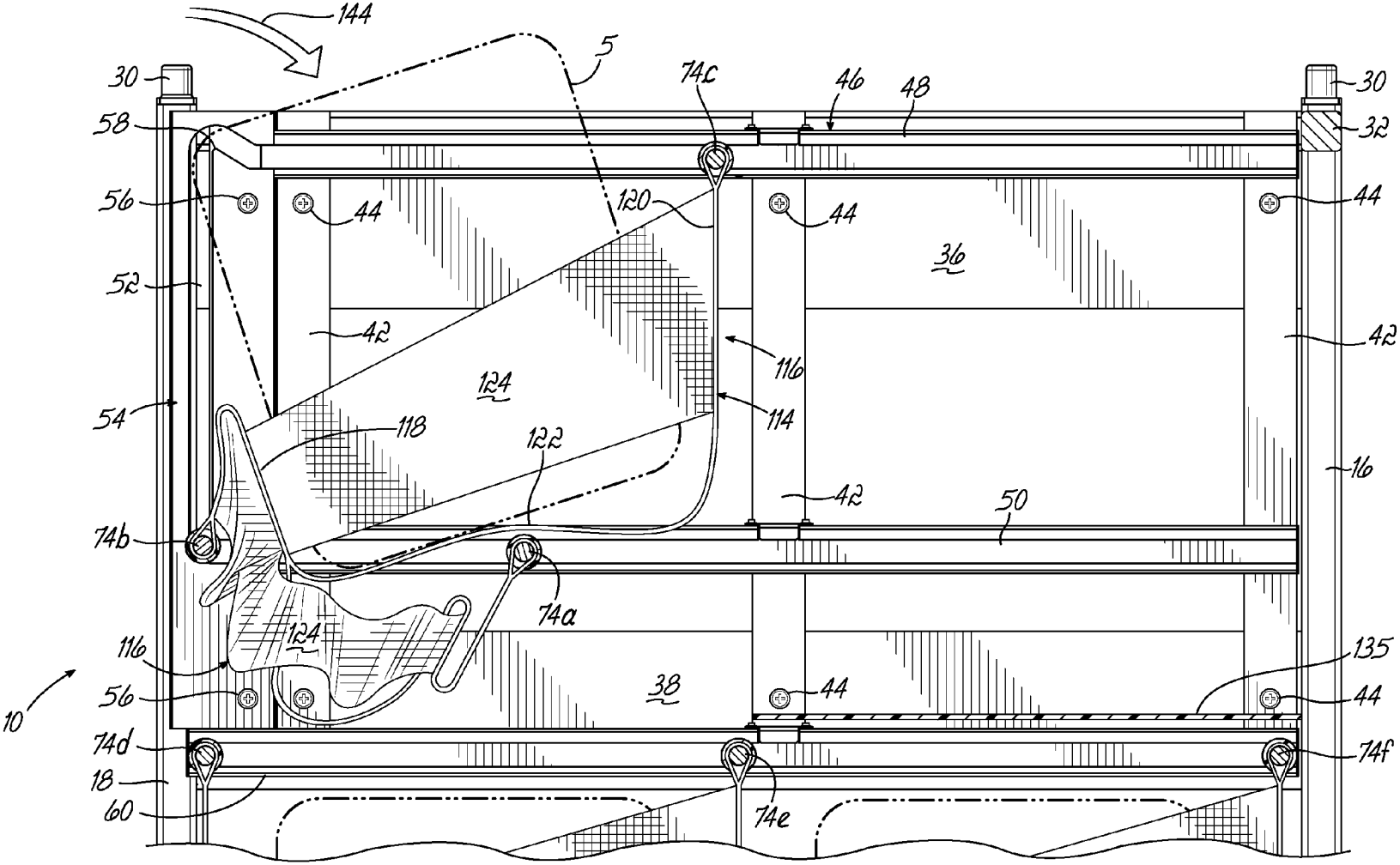
FIG. 4D is a cross-sectional view of a portion of the container of FIG. 1, showing a product being inserted into a rear pouch of the upper layer of dunnage.

As shown in FIG. 4D, the next step comprises inserting another product 5 into the rear pouch 116 of the upper level of dunnage 112*a* in the direction of arrow 144. As shown in FIG. 4D, when the dunnage support 74*c* is in a position extending between the upper portions 48 of generally U-shaped tracks 46, and the dunnage support 74*b* is in a position extending between the connecting portions 52 of generally U-shaped tracks 46, the first product 5 is inserted into the back or rear pouch 116 of the upper layer or level 112*a* of pouches 116.

Figure 4E:
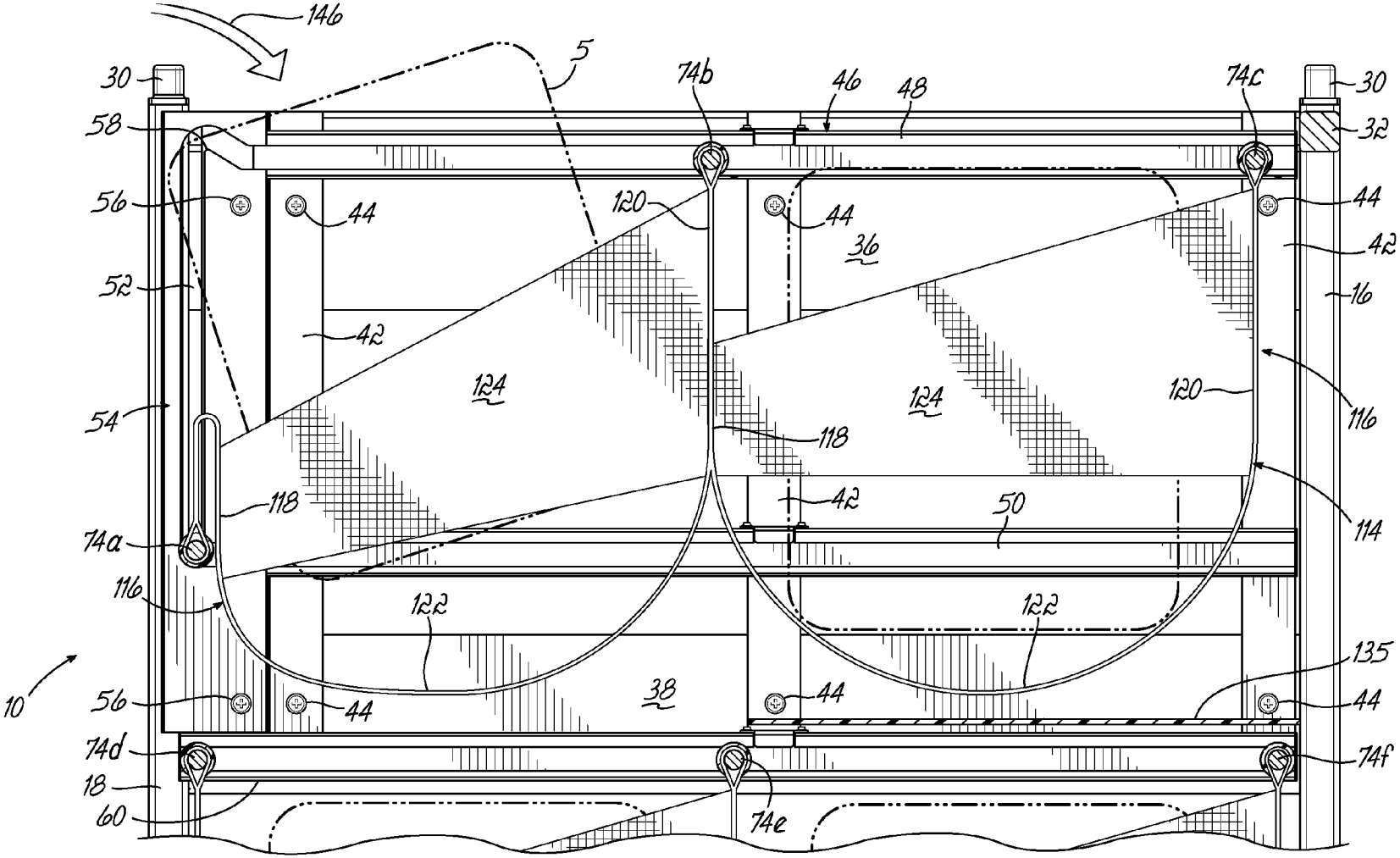
FIG. 4E is a cross-sectional view of a portion of the container of FIG. 1, showing another product being inserted into a front pouch of the upper layer of dunnage.

As shown in FIG. 4E, the next step comprises raising dunnage support 74*b* extending between the connecting portions 52 of generally U-shaped tracks 46, over the bumps 58 of the generally U-shaped tracks 46 and rearwardly along the upper portions 48 of generally U-shaped tracks 46 to a position shown in FIG. 4E, the loaded rear pouch 116 supported by dunnage supports 74*b* and 74*c* moving rearwardly. Once the dunnage supports 74*a*-74*c* are in their positions illustrated in FIG. 4E, the operator (not shown) inserts another product 5 into the front pouch 116 of the upper level of dunnage 112*a* in the direction of arrow 146. In the event the upper level of dunnage contains more than the two pouches shown, this process may be repeated. Each time a product 5 is inserted into a dunnage pouch 116 of the upper level of dunnage 112*a*, the dunnage supports 74*a*-74*c* are moved rearwardly with the pouches 116 containing product 5, the end members 76 at the ends of the dunnage supports moving along the generally U-shaped tracks 46.

As shown in FIG. 4D, when dunnage support 74*b* is located extending between the bottoms of the connecting portions 52 of the generally U-shaped tracks 46, and dunnage support 74*c* is located extending between the upper portions 48 of the generally U-shaped tracks 46, an operator may easily insert a product 5 inside the rear pouch 116 because the dunnage support 74*b* is below dunnage support 74*c*. As shown in FIG. 4E, this is also true when dunnage support 74*a* is below dunnage support 74*b* when an operator is loading a product 5 into the front pouch of the upper layer of dunnage. This orientation of the dunnage supports, due to the configuration of the U-shaped tracks 46, helps an operator from an ergonomic standpoint, reducing the stress and strain on the body of the operator when loading product into the upper layer or level 112*a* of dunnage 114. Thus, the unique configuration of the upper generally U-shaped tracks 46 inside the container 10 may reduce the container owner's costs because workers or operators may have fewer injuries/days off due to injury.

Figure 4F:
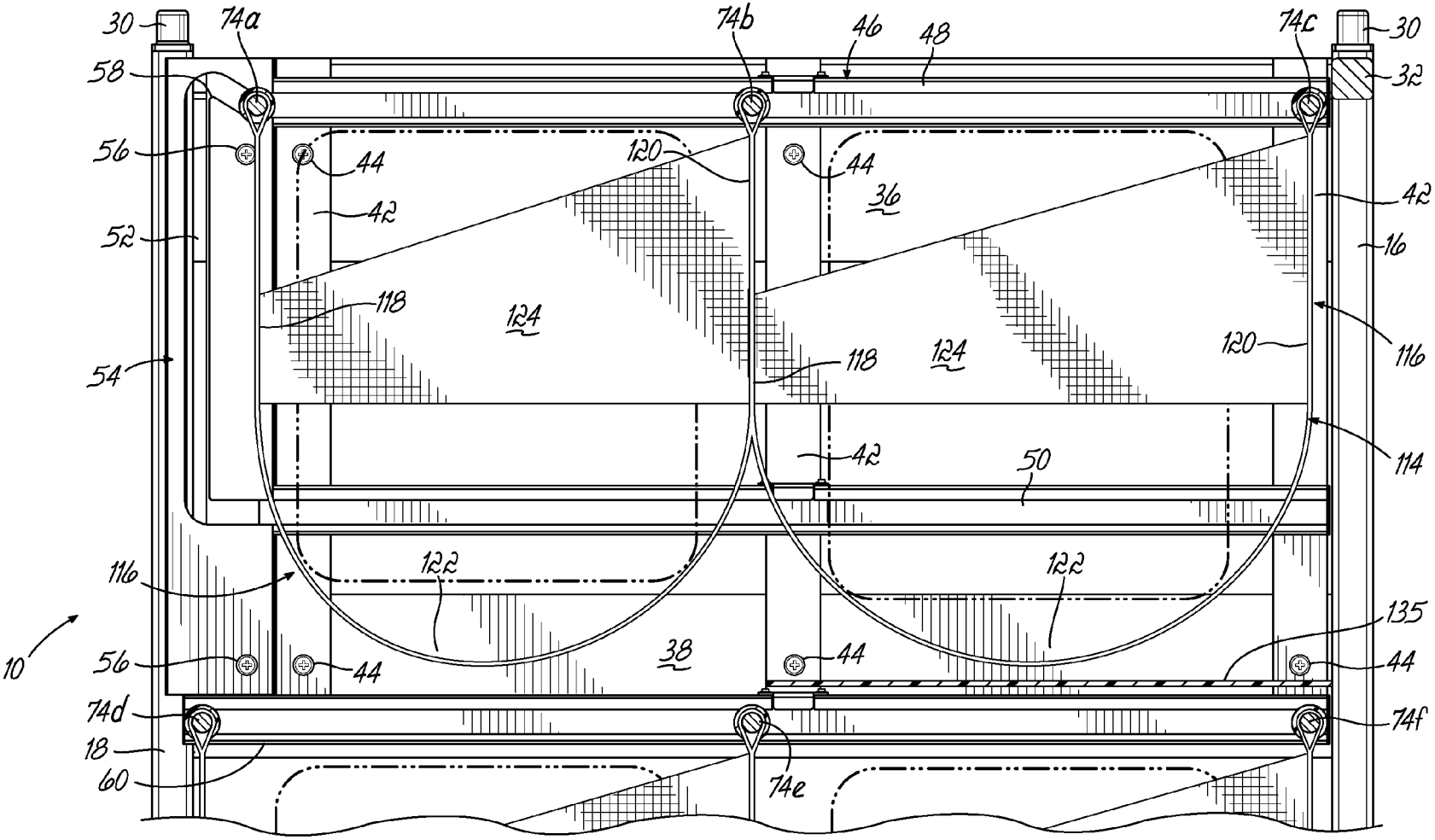
FIG. 4F is a cross-sectional view of a portion of the container of FIG. 1, showing each of the pouches of the upper layer of dunnage containing a product.

As shown in FIG. 4F, once all of the pouches 116 of the upper level of dunnage 112*a* have been loaded with product 5, and the dunnage supports 74*a*-74*c* extend between the upper portions 48 of generally U-shaped tracks 46 behind the curved bumps 58, the full container may be shipped to its desired destination. In the event, the container has more than two levels or layers, the process of loading product 5 is continued by an operator one level at a time, moving upwardly until the container is full of product 5.

Although one specific shape of product 5 is illustrated in the drawings, this document is not intended to limit in any way the size, shape or configuration of product 5 shipped or stored in any of the embodiments described or shown herein.

Figure 5A:
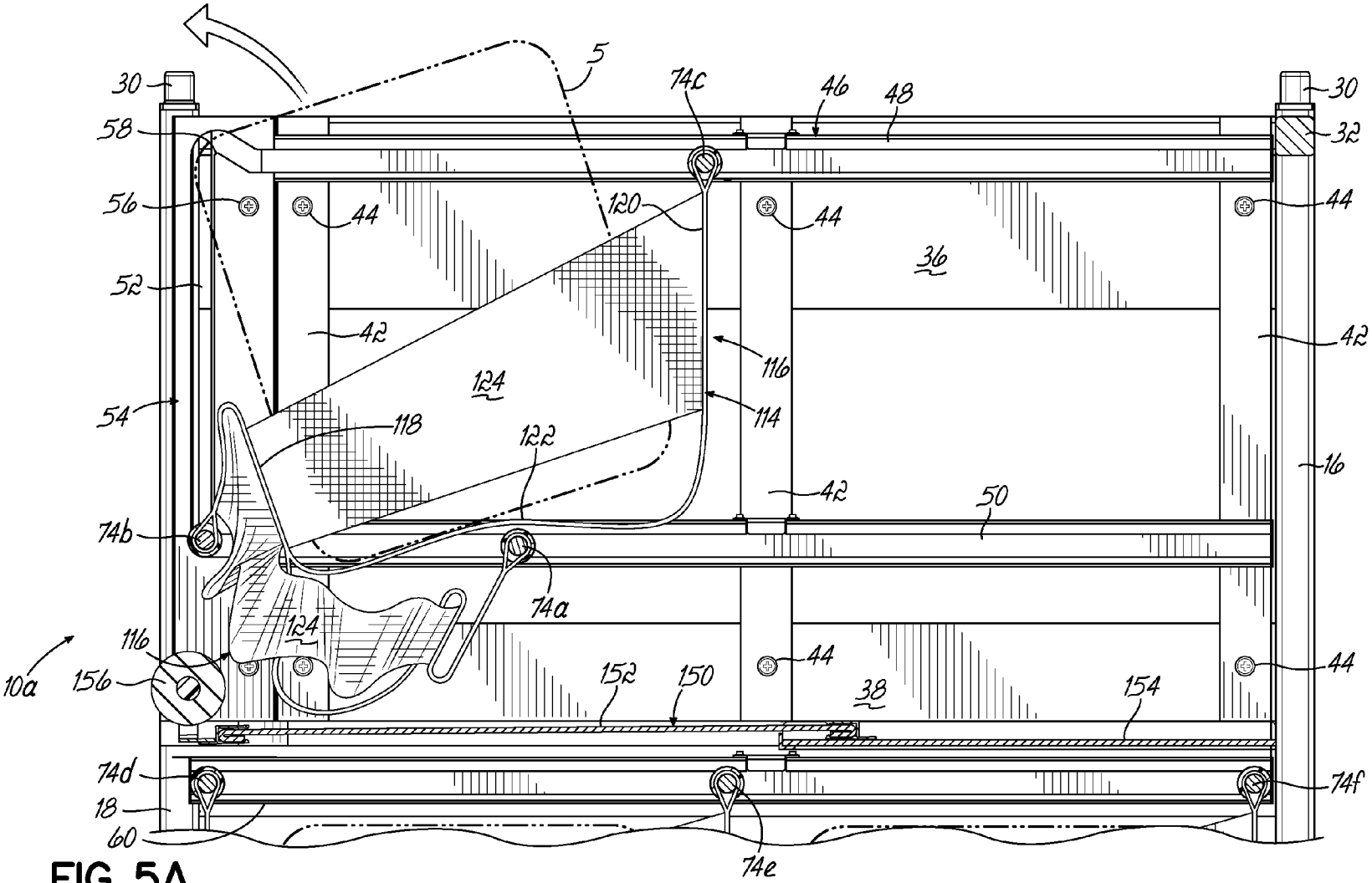
FIG. 5A is a cross-sectional view of a portion of an alternative embodiment of container, having a two-piece shelf between the upper and lower levels of dunnage, the shelf being in an extended position.
Figure 5B:
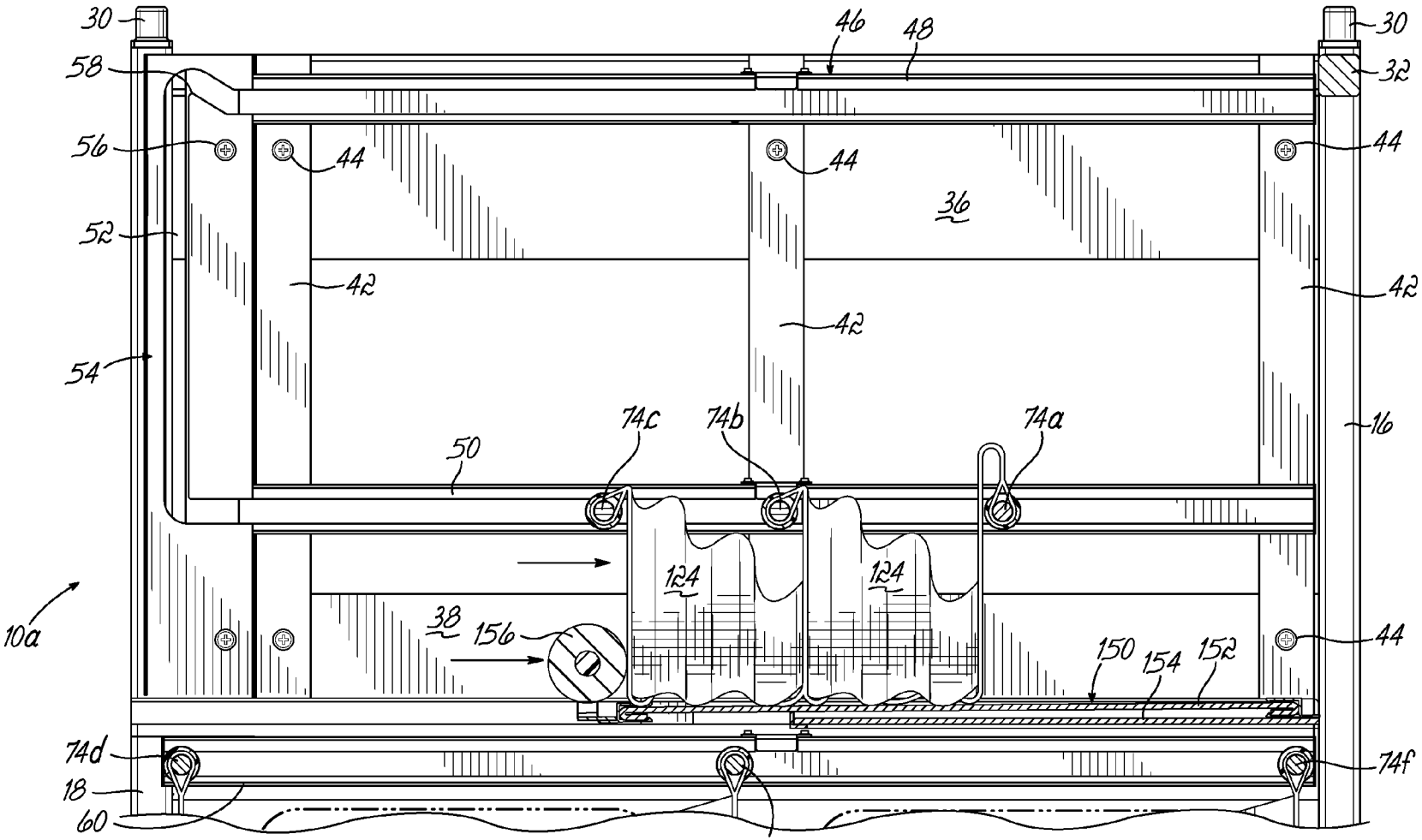
FIG. 5B is a cross-sectional view of a portion of the container of FIG. 5A, showing the shelf in a contracted position.

FIGS. 5A and 5B illustrate an alternative embodiment of container 10*a*. Container 10*a* is identical to container 10, except for the shelf. Container 10*a* has a two-piece shelf assembly 150 having two pieces 152, 154, while the container 10 has only one stationary piece 135. Shelf assembly 150 comprises a front movable piece 152 and a rear stationary piece 154 located immediately above the lower track 60, as shown in FIGS. 5A and 5B. The loading and unloading processes described herein are identical in both containers, except that in container 10*a*, the front piece 152 of shelf assembly 150 may be moved from a first position shown in FIG. 5A to a second position shown in FIG. 5B. At least one bumper 156 is attached to the front of the first piece 152 of shelf assembly 150. As shown in FIG. 5B, the bumper(s) 156 helps push or move the empty dunnage rearwardly after the upper layer of dunnage has been emptied, as shown in FIG. 5B.

FIGS. 6-11 illustrate another embodiment of reusable and returnable container 10*b*. The reusable and returnable container 10*b*, as shown, comprises a base 160, two sides 162 and a rear 164, each extending upwardly from base 160. The base 160 has openings therein 165 adapted to receive portions of a forklift (not shown) for purposes of lifting and moving the container 10*b*. Container 10*b* may further comprise a door assembly (not shown) at the front of the container, which may be any of the door assemblies disclosed in U.S. patent application Ser. No. 13/896,675 or pending U.S. patent application Ser. No. 13/975,682, each application of which is fully incorporated herein.

Figure 7:
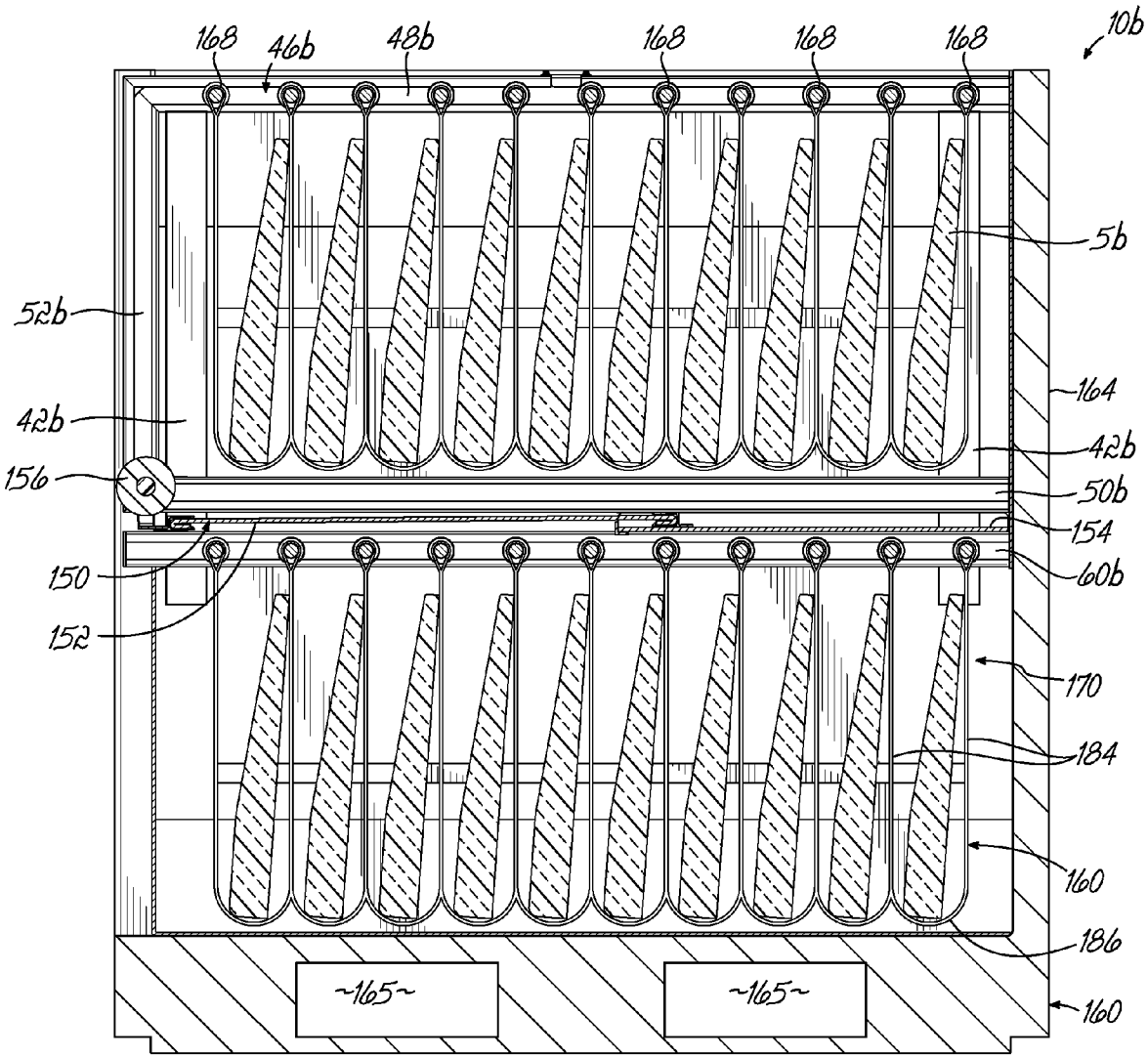
FIG. 7 is a is a cross-sectional view taken along the line 7-7 of FIG. 6.

As best shown in FIG. 7, container 10*b* further comprises a plurality of generally vertically oriented spaced straps 42*b* secured to each of the sides 162 with fasteners 44*b* on each side of the container. Although the drawings show two straps 42*b* on each side of the container, any number of straps may be used on each side of the container. The straps 42*b* may be made of metal or any other desired material.

As shown in FIG. 7, a stationary generally U-shaped track 46*b* is secured to the straps 42*b* on each side of the container 10 in any desired manner, such as welding, for example. In some applications, the straps may be omitted and the stationary generally U-shaped track 46*b* secured directly to each side wall of the container 10 in any desired manner, such as with fasteners, for example. The generally U-shaped track 46*b* comprises stationary generally horizontally oriented upper and lower portions 48*b*, 50*b*, respectively, vertically spaced apart from each other at different levels and generally parallel to each other. A connecting portion 52*b* joins front portions of the upper and lower linear portions 48*b*, 50*b*, respectively, of the generally U-shaped track 46*b* on each side of the container. The generally U-shaped track 46*b* may be made of one piece or multiple pieces, welded or otherwise secured together. The generally U-shaped track 46*b* is welded or otherwise secured to the straps 42*b* on each side of container 10. However, it may be secured in place in any known manner. Although not shown, the upper portion 48*b* of the generally U-shaped track 46*b* may have an inhibitor or bump or curved upper portion located at the front thereof to aid in maintaining the dunnage supports in the upper portion 48*b* of the generally U-shaped track 46*b* during shipment, like the one shown in FIG. 1B.

On each side of the container 10*b*, a stationary linear lower track 60*b* is spaced below the lower linear portion 50*b* of the generally U-shaped track 46*b*. On each side of the container, stationary linear lower track 60*b* is welded or otherwise secured to the straps 42*b*. As shown in FIG. 7, each linear lower track 60*b* may have a greater length than the upper and lower linear portions 48*b*, 50*b*, respectively, of each of the generally U-shaped tracks 46*b*. As shown in FIG. 7, the linear lower track 60*b* is below the generally U-shaped track 46*b* when the container is in its position shown in FIG. 7. For purposes of this document, the description of the positioning of various components is described with respect to the container 10*b* being in the position illustrated in FIG. 7.

Each generally U-shaped track 46*b* and each lower track 60*b* is fixed in a stationary position on one side of the container because each track is welded or otherwise secured to multiple straps 42*b*. The tracks are arranged in corresponding pairs at the same vertical levels. Each track may be one-piece or multiple pieces. Although the drawings disclose one generally U-shaped track 46*b* and one linear track

60*b* welded or otherwise secured to the straps 42*b* on each side of the container, the container may have any number of different levels or layers of tracks. As best shown in FIG. 1C, each of the straight upper and lower portions 48*b*, 50*b*, respectively, of the generally U-shaped track 46*b*, and/or the lower linear track 60*b* may have an opening therein covered with a cover.

Figure 8:
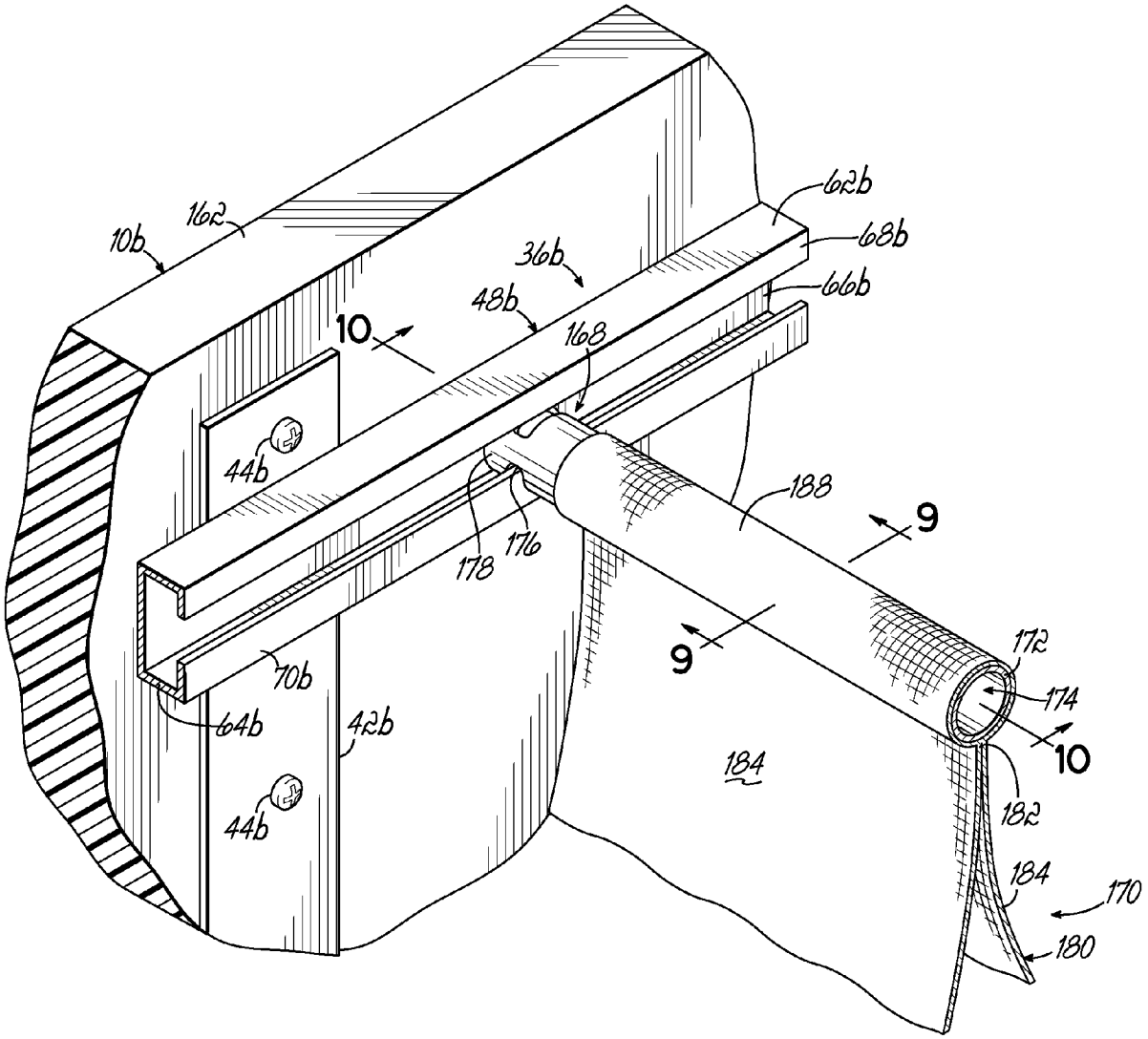
FIG. 8 is an enlarged view of the encircled area 8 of FIG. 6.
Figure 9:
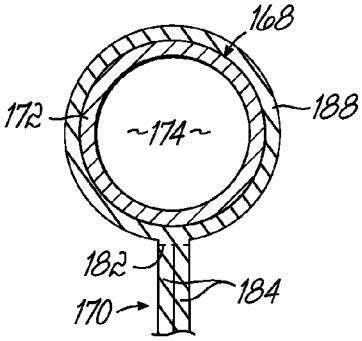
FIG. 9 is a is a cross-sectional view taken along the line 9-9 of FIG. 8.

As shown in FIGS. 8 and 10, upper and lower linear portions 48*b*, 50*b* of each generally U-shaped track 46*b* and each linear track 60*b* has a generally C-shape in cross-section. Each track 60 or generally U-shaped track 46*b*, including any track portion 48*b*, 50*b*, has a back 66*b*, an upper wall 62*b* and a lower wall 64*b* each extending outwardly from the back 66*b*. As shown in FIG. 8, track portion 48*b* further comprises a lower lip 70*b* extending upwardly from the inner edge of the lower wall 64*b* and an upper lip 68*b* extending downwardly from the inner edge of the upper wall 62*b*. Although not shown, any of the tracks or track portions shown or described herein may have an alternative configuration, such as those disclosed in U.S. patent application Ser. No. 13/225,835, which is fully incorporated herein.

Figure 6:
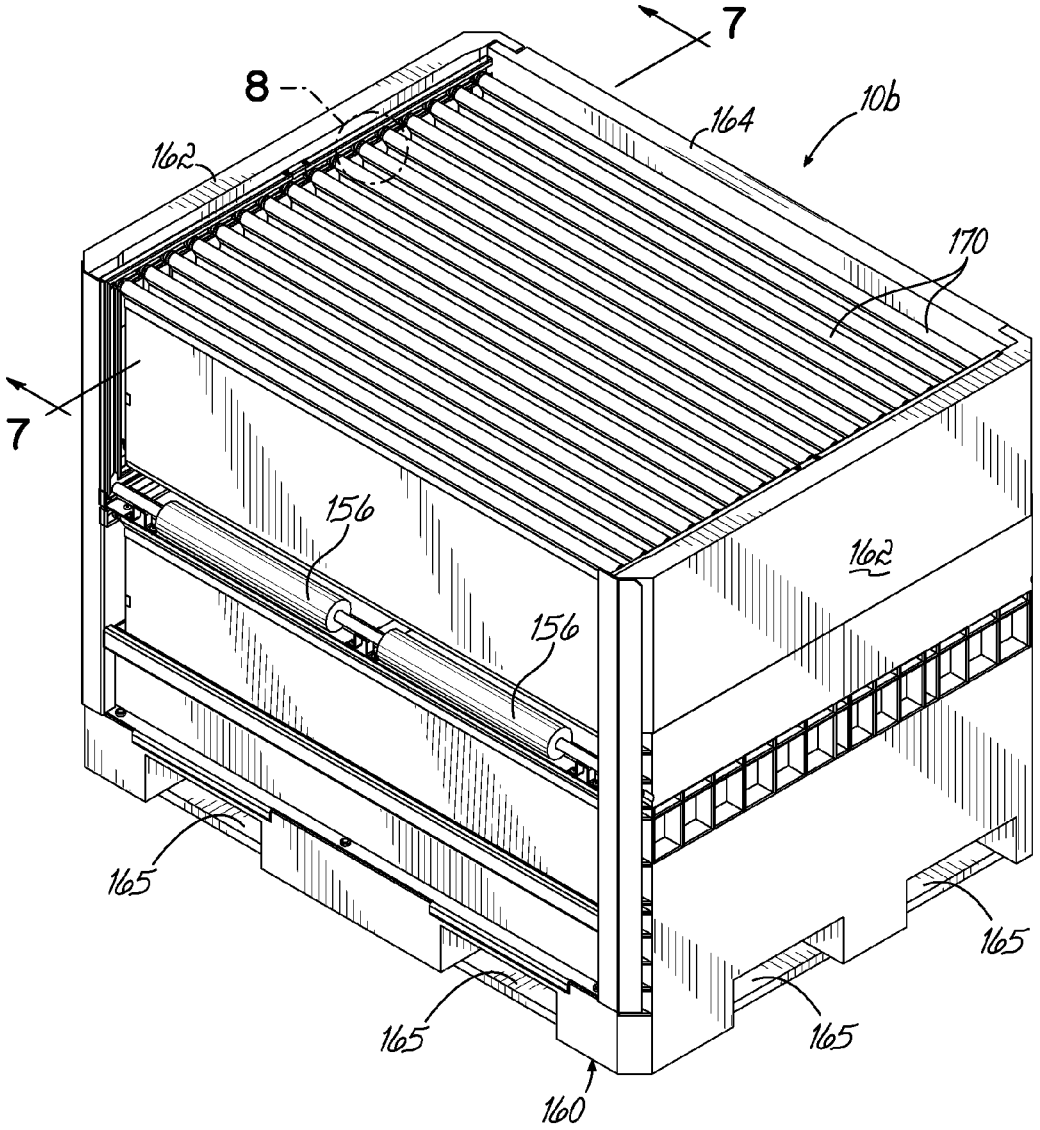
FIG. 6 is a perspective view of another embodiment of a reusable and returnable container.

Referring to FIGS. 6 and 7, container 10*b* further comprises a plurality of dunnage supports 168, each dunnage support 168 extending between the upper linear portions 48*b* of the generally U-shaped tracks 46*b* at the same level on opposed sides of the container. As shown in FIG. 7, container 10*b* further comprises a plurality of additional dunnage supports 168, each additional dunnage support 168 extending between the tracks 60*b* at the same level on opposed sides of the container.

FIG. 7 illustrates two levels of dunnage supports 168, each dunnage support 168 being a unitary member and extending between a pair of tracks at the same level or height. The tracks 46*b*, 60 support the weight of the dunnage supports 168 and associated dunnage 170, as described below. FIGS. 8 and 10 illustrate a portion of one of the dunnage supports 168. Dunnage supports or cross members 168 may be made of metal or plastic, such as polyvinyl chloride, known as PVC. As shown in FIG. 10, each dunnage support 168 has a wall 172 of a thickness "T" and a hollow interior 174. As best shown in FIGS. 8 and 10, each dunnage support 168 at each end has two notches or cut-outs 176 located in an end portion 178 (only one being shown). The lips 68*b*, 70*b* of one of the tracks or track portions reside inside the notches 176 of one of the dunnage supports 168, as shown in FIG. 10, enabling the dunnage support 168 to move or slide thereon. Each notch 176 is sized to reside on and engage one of the tracks or track portions. See FIGS. 8 and 10. A portion of the end portion 178 of each dunnage support 168 resides inside the interior of one of the tracks or track portions and moves therein upon movement of the dunnage support 168. Each notch or cut-out may be any desired configuration and is not intended to be limited by the drawings of this document. Similarly, the location and number of notches or cut-outs of each dunnage support is not intended to be limited by the drawings of this document. For example, one of the notches may be omitted, as disclosed in U.S. patent application Ser. No. 13/225,835, which is fully incorporated herein.

The dunnage 170 of each level or layer may comprise one or more pieces of dunnage material. In one embodiment, one piece of dunnage material is used for one level or layer of dunnage 70. However, multiple pieces of material may be used in one or more levels or layers of dunnage. The material may be a textile material, such as polyester. However, this document is not intended to limit the material of the dunnage.

The drawings show the dunnage 170 supported by the dunnage supports 168 being in the form of pouches 180, each level having its own level of pouches. Two adjacent dunnage supports 168 support a pouch 180 having two sides 184 joined together with a bottom portion 186, as shown in FIG. 7. Each level of pouches 180 may be made from one piece of material or multiple pieces of material. As best shown in FIG. 8, the dunnage 170 or pouches 180 at each level may be supported by the dunnage supports 168. As shown in FIG. 8, the fabric of the pouch 180 is sewn or otherwise secured together along a seam 182 to make a pocket 188 in which is located one of the dunnage supports 168. Alternatively, each dunnage support 168 may comprise multiple pieces joined together as shown in the drawings and described herein.

As best shown in FIG. 7, container 10*b* has a two-piece shelf assembly 150 having two pieces 152, 154 and two bumpers 156 attached to the front of the first piece 152 of shelf assembly 150. Shelf assembly 150 works as described above with respect to container 10*a*, and may be used in any container described or illustrated herein.

FIG. 7 illustrates each pouch 180 containing a product 5*b*. Although one specific shape of product 5*b* is illustrated in the drawings, this document is not intended to limit in any way the size, shape or configuration of product 5*b* shipped or stored in any of the embodiments described or shown herein.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a base and two opposed sides;

a stationary upper track and a stationary lower track supported by each side of the container, the stationary upper track on each of the sides being non-linear, wherein each of the non-linear upper tracks is generally U-shaped having an upper portion extending from front to back inside the container proximate an upper edge of the container and a lower portion extending from front to back inside the container spaced below the upper portion, the upper and lower portions being joined by a connecting portion located at the front of the container;

upper dunnage supports extending between the upper tracks and being movable along the upper tracks;

an upper layer of dunnage supported by the upper dunnage supports;

lower dunnage supports extending between the lower tracks and being movable along the lower tracks;

a lower layer of dunnage supported by the lower dunnage supports; and a shelf assembly between the upper and lower tracks for moving the upper layer of dunnage rearwardly once emptied.

2. The container of claim 1 wherein each side of the container has two tracks.

3. The container of claim 2 wherein each of the non-linear tracks is generally U-shaped.

4. The container of claim 1 wherein at least one of the tracks on each of the sides is linear.

5. The container of claim 1 wherein the container has at least two tracks on each of the sides, at least one of the tracks being linear.

6. The container of claim 1 wherein each of the non-linear tracks has an inhibitor to aid in maintaining the dunnage supports in an upper level of the non-linear track.

7. The container of claim 6 wherein each of the inhibitors comprises a bump.

8. The container of claim 1 wherein at least one of the upper and lower layers of dunnage comprises pouches.

9. The container of claim 1 wherein the base and sides are part of a metal frame.

10. A container for holding product therein during shipment, the container comprising:

a base and opposed sides;

first and second tracks supported by each of the opposed sides, the first track on each side being generally U-shaped having an upper portion extending from front to back inside the container proximate an upper edge of the container and a lower portion extending from front to back inside the container spaced below the upper portion, the upper and lower portions being joined by a connecting portion located at the front of the container;

a plurality of dunnage supports extending between opposed tracks and being movable along corresponding tracks;

pouches supported by the dunnage supports; and a movable shelf assembly between the first and second tracks for moving the pouches rearwardly once emptied.

11. The container of claim 10 wherein each of the dunnage supports comprises a pair of end members and a middle member extending between the end members.

12. The container of claim 10 further comprising metal straps on each side of the container, each of the tracks on each side of the container being secured to the metal straps.

13. The container of claim 10 wherein each side of the container has two tracks, a non-linear track and a linear track.

14. The container of claim 13 wherein each non-linear track is generally U-shaped.

15. The container of claim 14 wherein each of the non-linear tracks has an inhibitor to aid in maintaining the dunnage supports in an upper level of the non-linear track.

16. The container of claim 15 wherein the base and sides are part of a metal frame.

17. A container for holding product therein during shipment, the container comprising:

a base and opposed sides;

tracks supported by each side of the container at different levels, an uppermost track on each side being non-linear, wherein at least one of the non-linear tracks is generally U-shaped having an upper portion extending from front to back inside the container proximate an upper edge of the container and a lower portion extending from front to back inside the container spaced apart from the upper portion, the upper and lower portions being joined by a connecting portion located at the front of the container;

a plurality of dunnage supports movable along the tracks;

pouches supported by the dunnage supports; and a shelf assembly between the opposed sides of the container below at least one of the tracks on each side of the container for moving the pouches.

18. The container of claim 17 wherein each side of the container has at least one linear track.

19. The container of claim 17 wherein each of the generally U-shaped tracks has an inhibitor to aid in maintaining the dunnage supports in an upper level of the track.

20. The container of claim 17 wherein each side of the container has a linear track, the generally U-shaped track being above the linear track.

21. The container of claim 17 wherein the base and sides are part of a metal frame.

22. The container of claim 17 wherein each of the dunnage supports comprises end members movable along corresponding tracks and a middle member extending between the end members.

* * * * *